US010228167B2

(12) United States Patent
Flynn et al.

(10) Patent No.: US 10,228,167 B2
(45) Date of Patent: Mar. 12, 2019

(54) SYSTEMS AND METHODS FOR WARMING A CRYOGENIC HEAT EXCHANGER ARRAY, FOR COMPACT AND EFFICIENT REFRIGERATION, AND FOR ADAPTIVE POWER MANAGEMENT

(75) Inventors: Kevin P. Flynn, Novato, CA (US); Yongqiang Qiu, San Rafael, CA (US); HaeYong Moon, Westford, MA (US)

(73) Assignee: Brooks Automation, Inc., Chelmsford, MA (US)

( * ) Notice: Subject to any disclaimer, the term of this patent is extended or adjusted under 35 U.S.C. 154(b) by 217 days.

(21) Appl. No.: 14/130,263

(22) PCT Filed: Jun. 29, 2012

(86) PCT No.: PCT/US2012/044891

§ 371 (c)(1),
(2), (4) Date: Dec. 30, 2013

(87) PCT Pub. No.: WO2013/006424

PCT Pub. Date: Jan. 10, 2013

(65) Prior Publication Data

US 2014/0144165 A1 May 29, 2014

Related U.S. Application Data

(60) Provisional application No. 61/503,702, filed on Jul. 1, 2011, provisional application No. 61/566,340, filed on Dec. 2, 2011.

(51) Int. Cl.

| | |
|---|---|
| ***F25B 49/00*** | (2006.01) |
| ***F25B 29/00*** | (2006.01) |
| ***F25B 9/00*** | (2006.01) |

(52) U.S. Cl.

CPC ..... *F25B 29/003* (2013.01); *F25B 9/00* (2013.01); *F25B 49/005* (2013.01); *F25B 2400/04* (2013.01); *F25B 2600/2501* (2013.01)

(58) Field of Classification Search

CPC ..... F25B 47/02; F25B 47/022; F25B 47/025; F25B 9/006

(Continued)

(56) References Cited

U.S. PATENT DOCUMENTS

| | | | |
|---|---|---|---|
| 3,992,167 | A | 11/1976 | Beddome |
| 4,176,526 | A | 12/1979 | Missimer |

(Continued)

FOREIGN PATENT DOCUMENTS

| | | | |
|---|---|---|---|
| CN | 101382364 | A | 3/2009 |
| CN | 101929761 | A | 12/2010 |

(Continued)

OTHER PUBLICATIONS

Notification Concerning Transmittal of International Preliminary Report on Patentability for International Application No. PCT/US2012/044891; dated Feb. 25, 2014; Entitled "Systems and Methods for Warming a Cryogenic Heat Exchanger Array, for Compact and Efficient Refrigeration, and for Adaptive Power Management".

(Continued)

*Primary Examiner* — Jianying Atkisson
*Assistant Examiner* — Antonio R Febles
(74) *Attorney, Agent, or Firm* — Hamilton, Brook, Smith & Reynolds, P.C.

(57) ABSTRACT

In accordance with an embodiment of the invention, there is provided a method of warming a heat exchanger array of a very low temperature refrigeration system, the method comprising diverting at least a portion of refrigerant flow in the refrigeration system away from a refrigerant flow circuit used during very low temperature cooling operation of the refrigeration system, to effect warming of at least a portion of the heat exchanger array; and while diverting the at least (Continued)

a portion of refrigerant flow, preventing excessive refrigerant mass flow through a compressor of the refrigeration system.

28 Claims, 13 Drawing Sheets

(58) Field of Classification Search
USPC ..... 62/81, 151, 277, 80
See application file for complete search history.

(56) References Cited

U.S. PATENT DOCUMENTS

| | | | | |
|---|---|---|---|---|
| 4,535,597 | A | 8/1985 | Missimer et al. | |
| 4,597,267 | A | 7/1986 | Forrest | |
| 4,763,486 | A | 8/1988 | Forrest et al. | |
| 6,574,978 | B2 | 6/2003 | Flynn et al. | |
| 6,644,067 | B2 | 11/2003 | Stenhouse | |
| 6,843,065 | B2 * | 1/2005 | Flynn ..... | C09K 5/045 62/156 |
| 7,478,540 | B2 | 1/2009 | Flynn et al. | |
| 7,490,483 | B2 | 2/2009 | Boiarski et al. | |
| 2004/0020221 | A1 | 2/2004 | Flynn | |
| 2006/0168976 | A1 | 8/2006 | Flynn et al. | |
| 2009/0188270 | A1 | 7/2009 | Takahashi et al. | |

FOREIGN PATENT DOCUMENTS

| | | | |
|---|---|---|---|
| EP | 0840076 | A1 | 5/1998 |
| JP | 2006153287 | A | 6/2006 |
| KR | 100176929 | B1 | 10/1999 |

OTHER PUBLICATIONS

International Search Report and Written Opinion for International Application No. PCT/US2012/044891; dated Feb. 27, 2014; Entitled "Systems and Methods for Warming a Cryogenic Heat Exchanger Array, for Compact and Efficient Refrigeration, and for Adaptive Power Management ".

Invitation to Pay Additional Fees and, Where Applicable, Protest Fee, and Annex to Form PCT/ISA/206 Communication Relating to the Results of the Partial International Search dated Nov. 28, 2013 from PCT Application No. PCT/US2012/044891, Internationally Filed Jun. 29, 2012, Entitled "Systems and Methods for Warming a Cryogenic Heat Exchanger Array, for Compact and Efficient Refrigeration, and for Adaptive Power Management. "

* cited by examiner

BROOKS AUTOMATION

Polycold XC CryoChiller STATUS

HOME | STATUS | CONFIGURATION | SERVICE

| CIRCUIT 1 STATUS | | CIRCUIT 2 STATUS | |
|---|---|---|---|
| MODE | STANDBY | MODE | STANDBY |
| Coil In Temperature | 45.099998 | Coil In Temperature | 39.599998 |
| Coil Out Temperature | 29.100000 | Coil Out Temperature | 39.700001 |
| Feed Temperature | 46.000000 | Feed Temperature | 48.099998 |
| Return Temperature | 3.300000 | Return Temperature | 6.400000 |
| Process Temperature | 171.800003 | Process Temperature | 29.100000 |
| CRYOCOOLER | | GENERAL | |
| Compressor Discharge Temperature | 112.800003 | Fault Description | None |
| Liquid Line Temperature | 23.799999 | | |
| Coldest Liquid Temperature | -131.199997 | | |
| Stack Warm Control Temperature | -38.599998 | Warning Description | C1 inlet sensor:No Recommen |
| Bypass Temperature | 25.100000 | | C1 inlet sensor:No Recommendation |
| Buffer Line Temperature | 36.599998 | | |
| Relay 1 Setpoint | -80.000000 | | |
| Relay 2 Setpoint | -70.000000 | Serial Number | 12345 |
| Compressor ON/OFF | ON | Model Number | PFC/PFC-1102 HC |
| Compressor Suction Pressure | 15.400000 | Date | 2011-11-29 |
| Compressor Discharge Pressure | 282.500000 | Time | 11:36 PM |

Copyright 2011 - Brooks Automation, Inc.
All Rights Reserved

FIG. 8

SYSTEMS AND METHODS FOR WARMING A CRYOGENIC HEAT EXCHANGER ARRAY, FOR COMPACT AND EFFICIENT REFRIGERATION, AND FOR ADAPTIVE POWER MANAGEMENT

RELATED APPLICATIONS

This application is the U.S. National Stage of International Application No. PCT/US2012/044891, filed Jun. 29, 2012, which designates the U.S., published in English and claims the benefit of U.S. Provisional Application No. 61/503,702, filed on Jul. 1, 2011, and claims the benefit of U.S. Provisional Application No. 61/566,340, filed on Dec. 2, 2011. The entire teachings of the above applications are incorporated herein by reference.

BACKGROUND OF THE INVENTION

In normal engineering practice the heat exchangers of a very low temperature refrigeration system are well insulated to minimize parasitic heat losses. However, when there is a need to service the unit the insulation prevents rapid warming of the heat exchanger array. Thus, it may take more than 12, 24, 48 or even 72 hours for the heat exchanger array to achieve room temperature. This is typically done as a means to troubleshoot the unit. For example, if it is suspected that the system has a leak, the unit will be turned off and allowed to warm to check the pressure of the system at room temperature. Other service work, such as charge removal, or recovery after excess accumulation of moisture or other contaminants or of certain refrigerants at the coldest parts of the system also require such warming. This creates significant periods of time during which the equipment is not available for productive operations.

SUMMARY OF THE INVENTION

In accordance with an embodiment of the invention, there is provided a method of warming a heat exchanger array of a very low temperature refrigeration system. The method comprises diverting at least a portion of refrigerant flow in the refrigeration system away from a refrigerant flow circuit used during very low temperature cooling operation of the refrigeration system, to effect warming of at least a portion of the heat exchanger array; and while diverting the at least a portion of refrigerant flow, preventing excessive refrigerant mass flow through a compressor of the refrigeration system.

In further, related embodiments, the diverting at least a portion of the refrigerant flow may comprise diverting at least a portion of refrigerant flow from the compressor to a point in the heat exchanger array. The point in the heat exchanger array may comprise a low pressure inlet of a coldest heat exchanger in the heat exchanger array, or of a next-to-coldest heat exchanger in the heat exchanger array. The preventing excessive refrigerant mass flow may comprise operating a buffer valve to permit refrigerant to be stored in at least one of an expansion tank and a buffer tank of the refrigeration system. The buffer valve may be operated continuously or in a pulsed manner, and may be operated after a minimum suction pressure is reached. The diverting at least a portion of the refrigerant flow may comprise diverting at least a portion of refrigerant flow from an outlet of a condenser of the refrigeration system to a point in the heat exchanger array. The at least a portion of the refrigerant flow that is diverted may comprise refrigerant at a substantially warmer temperature than that of a coldest heat exchanger in very low temperature operation of the refrigeration system. The diverting may effect warming of all of the heat exchanger array. The method may comprise warming the at least a portion of the heat exchanger array from a temperature in the very low temperature range to a temperature from the group consisting of: at least about 5 C, at least about 10 C, at least about 15 C, at least 20 C, at least about 25 C, at least about 30 C and at least about 35 C. The diverting may comprise diverting at least a portion of refrigerant flow from a high pressure side of at least one heat exchanger in the heat exchanger array to another point in the heat exchanger array.

In further related embodiments, the diverting may comprise diverting at least a portion of refrigerant flow from a sequence of at least two sources of warming refrigerant in the refrigeration system, the at least two sources of warming refrigerant comprising at least one of: (i) different temperatures from each other, and (ii) different refrigerant compositions from each other. The diverting may comprise diverting at least a portion of refrigerant flow from an alternating sequence of the at least two sources of warming refrigerant in the refrigeration system. The diverting may comprise diverting at least a portion of refrigerant flow from at least two sources of warming refrigerant in the refrigeration system, the at least two sources of warming refrigerant comprising at least one of: (i) different temperatures from each other, and (ii) different refrigerant compositions from each other; and blending the diverted flow from the at least two sources of warming refrigerant to effect the warming of the at least a portion of the heat exchanger array. The diverting may comprise varying an amount of warming refrigerant during warming of the at least a portion of the heat exchanger array. The refrigerant flow may be diverted to more than one location in the heat exchanger array.

In another embodiment according to the invention, the refrigerant flow may be diverted from an outlet of the compressor to an inlet of a feed line from which refrigerant flows to at least one of a cryocoil or cryosurface and from there returns through a return line to a low pressure side of the heat exchanger array. The diverting may be continued after a temperature of the refrigerant in the return line returning to the low pressure side of the heat exchanger array has reached a high temperature set point of the return line. The high temperature set point may comprise a temperature in the range of from about −20 C to about +40 C. The preventing excessive refrigerant mass flow may comprise operating a buffer valve to permit refrigerant to be stored in at least one of an expansion tank and a buffer tank of the refrigeration system during the diverting of the at least a portion of the refrigerant flow. The buffer valve may be operated continuously or in a pulsed manner. The method may comprise operating the buffer valve after a temperature of the refrigerant in the return line returning to the low pressure side of the heat exchanger array has reached a high temperature set point of the return line. The method may comprise operating the buffer valve throughout the diverting of at least a portion of the refrigerant flow from an outlet of the compressor to an inlet of a feed line. The diverting to the inlet of the feed line may be continued until a temperature of the refrigerant in the return line returning to the low pressure side of the heat exchanger array has reached a high temperature set point of the return line, after which the diverting comprises diverting at least a portion of refrigerant flow from the compressor to a point in the heat exchanger array. The method may comprise warming at least a portion of the heat exchanger array using at least one of a freezeout prevention circuit and a temperature control circuit, prior to diverting at least a portion of refrigerant flow from the compressor to a point in the heat exchanger array. The diverting at least a portion of refrigerant flow may comprise diverting at least enough refrigerant flow to exceed a cooling effect produced by at least one internal throttle of the heat exchanger array, thereby warming the heat exchanger array. The method may comprise at least partially closing at least one internal throttle of the heat exchanger array for at least a portion of the warming of the heat exchanger array. The method may comprise at least partially blocking flow into or out of a condenser of the refrigeration system for at least a portion of the warming of the heat exchanger array. The method may comprise closing a suction side connection to an expansion tank of the refrigeration system for at least a portion of the warming of the heat exchanger array. The method may comprise controlling a location in the heat exchanger array to which the diverted refrigerant flow is directed.

In further related embodiments, the warming of the at least a portion of the heat exchanger array may permit a balance pressure check, when a high pressure of the system and a low pressure of the system are equal within a time, from commencing of the diverting of the at least a portion of the refrigerant flow in operation at a very low temperature, of at least one of: less than 6 hours, less than 4 hours, less than 3 hours, less than 2 hours, less than 1 hour, less than 30 minutes, less than 15 minutes and less than 5 minutes. The high pressure of the system and the low pressure of the system achieved at the balance pressure check may be within at least one of 5 psi, 10 psi, 20 psi and 30 psi of the natural balance pressure of the system. The method may comprise using no equipment external to the refrigeration system to effect warming of the heat exchanger array. The refrigeration system may comprise a mixed refrigeration system and the refrigerant may comprise a mixture of two or more refrigerants in which the difference between the normal boiling points from the warmest boiling component to the coldest boiling component is at least one of: at least 50K, at least 100K, at least 150 K, and at least 200K. The refrigeration system may comprise a compressor, at least one of a condenser and a desuperheater heat exchanger, the heat exchanger array, at least one throttle device and an evaporator. The refrigeration system may comprise at least one phase separator.

In further related embodiments, the method may be performed during at least a portion of a defrost mode operation of the refrigeration system in which the evaporator is warmed, the refrigeration system further operating in a cooling mode in which the evaporator is cooled and a standby mode in which no refrigerant is delivered to the evaporator. The method may comprise terminating warming of the at least a portion of the heat exchanger array when a set point temperature is reached by at least one sensor in at least one location in the heat exchanger array. The at least one sensor may be located in at least one of the following locations: a discharge inlet to a heat exchanger of the heat exchanger array; a discharge outlet from a heat exchanger of the heat exchanger array; a suction inlet to a heat exchanger of the heat exchanger array; and a suction outlet from a heat exchanger of the heat exchanger array. The preventing excessive refrigerant mass flow may comprise regulating refrigerant flow at an inlet to the compressor, such as by using a crank case pressure regulating valve; applying a variable speed drive to the compressor; blocking mass flow into at least one cylinder of the compressor (where the compressor is a reciprocating type compressor); separating at least two scrolls of the compressor from each other (where the compressor is a scroll type compressor); and/or reducing mass flow or curtailing operation of at least one compressor of multiple compressors of the refrigeration system.

In another embodiment according to the invention, there is provided a very low temperature refrigeration system comprising a warming system. The refrigeration system comprises a heat exchanger array; and a diverter diverting at least a portion of refrigerant flow in the refrigeration system away from a refrigerant flow circuit used during very low temperature cooling operation of the refrigeration system, and to a location in the heat exchanger array, to effect warming of at least a portion of the heat exchanger array, the diverter comprising at least one of: a diverter from the compressor to a point in the heat exchanger array; a diverter from an outlet of a condenser of the refrigeration system to a point in the heat exchanger array; and a diverter from a high pressure side of at least one heat exchanger in the heat exchanger array to another point in the heat exchanger array.

In further, related embodiments, the point in the heat exchanger array may comprise a low pressure inlet of a coldest heat exchanger in the heat exchanger array, or of the next-to-coldest heat exchanger in the heat exchanger array. The system may further comprise a device to prevent excessive refrigerant mass flow through the compressor. The device to prevent excessive refrigerant mass flow may comprise a buffer valve to permit refrigerant to be stored in at least one of an expansion tank and a buffer tank of the refrigeration system. The buffer valve may operate continuously or in a pulsed manner, and may be operated after a minimum suction pressure is reached. The device to prevent excessive refrigerant mass flow may comprise a regulator to regulate refrigerant flow at an inlet to the compressor, such as a crank case pressure regulating valve; a variable speed drive of the compressor; a cylinder unloader to block mass flow into at least one cylinder of the compressor (where the compressor is a reciprocating type compressor); a device to separate at least two scrolls of the compressor from each other (where the compressor is a scroll type compressor); and/or a device to reduce mass flow or curtail operation of at least one compressor of multiple compressors of the refrigeration system. The diverter may divert refrigerant at a substantially warmer temperature than that of a coldest heat exchanger in very low temperature operation of the refrigeration system. The diverter may effect warming of all of the heat exchanger array. The diverter may warm the at least a portion of the heat exchanger array from a temperature in the very low temperature range to a temperature from the group consisting of: at least about 5 C, at least about 10 C, at least about 15 C, at least about 20 C, at least about 25 C, at least about 30 C and at least about 35 C.

In other related embodiments, the diverter may divert refrigerant flow from a sequence of at least two sources of warming refrigerant in the refrigeration system, the at least two sources of warming refrigerant comprising at least one of: (i) different temperatures from each other, and (ii) different refrigerant compositions from each other. The diverter may divert at least a portion of refrigerant flow from an alternating sequence of the at least two sources of warming refrigerant in the refrigeration system. The diverter may divert at least a portion of refrigerant flow from at least two sources of warming refrigerant in the refrigeration system, the at least two sources of warming refrigerant comprising at least one of: (i) different temperatures from each other, and (ii) different refrigerant compositions from each other; and blend the diverted flow from the at least two sources of warming refrigerant to effect the warming of the at least a portion of the heat exchanger array. The diverter may deliver a varying amount of warming refrigerant during warming of the at least a portion of the heat exchanger array. The diverter may divert refrigerant flow to more than one location in the heat exchanger array.

In further related embodiments, the system may further comprise at least one internal throttle in the heat exchanger array. At least one of the internal throttles may comprise a device to at least partially close the internal throttle during operation of the diverter. The system may comprise a device to at least partially block flow into or out of the condenser of the system during operation of the diverter. The system may comprise a device to close a suction side connection to an expansion tank of the refrigeration system for at least a portion of the warming of the heat exchanger array. The system may comprise a valve to control a location in the heat exchanger array to which the diverted refrigerant flow is directed. The warming of the at least a portion of the heat exchanger array by the diverter may permit a balance pressure check, when a high pressure of the system and a low pressure of the system are equal within a time, from commencing of the diverting of the at least a portion of the refrigerant flow in operation at a very low temperature, of at least one of: less than 6 hours, less than 4 hours, less than 3 hours, less than 2 hours, less than 1 hour, less than 30 minutes, less than 15 minutes and less than 5 minutes. The high pressure of the system and the low pressure of the system achieved at the balance pressure check may be within at least one of 5 psi, 10 psi, 20 psi and 30 psi of the natural balance pressure of the system.

In further related embodiments, the system may comprise no equipment external to the refrigeration system to effect warming of the heat exchanger array. The system may comprise a mixed refrigeration system and the refrigerant may comprise a mixture of two or more refrigerants in which the difference between the normal boiling points from the warmest boiling component to the coldest boiling component is at least one of: at least 50K, at least 100K, at least 150 K, and at least 200K. The system may comprise a compressor, at least one of a condenser and a desuperheater heat exchanger, the heat exchanger array, at least one throttle device and an evaporator. The system may comprise at least one phase separator. The refrigeration system may permit a defrost mode operation in which the evaporator is warmed, a cooling mode operation in which the evaporator is cooled and a standby mode in which no refrigerant is delivered to the evaporator. The system may comprise at least one sensor in at least one location in the heat exchanger array and a control circuit to terminate operation of the diverter when a set point temperature is reached by at least one sensor. The at least one sensor may be located in at least one of the following locations: a discharge inlet to a heat exchanger of the heat exchanger array; a discharge outlet from a heat exchanger of the heat exchanger array; a suction inlet to a heat exchanger of the heat exchanger array; and a suction outlet from a heat exchanger of the heat exchanger array. The system may further comprise a hot gas defrost circuit from an outlet of the compressor to an inlet of a feed line from which refrigerant flows to at least one of a cryocoil or cryosurface and from there returns through a return line to a low pressure side of the heat exchanger array. The system may further comprise at least one of a freezeout prevention circuit and a temperature control circuit.

In another embodiment according to the invention there is provided a method of operating a very low temperature refrigeration system. The method comprises flowing a refrigerant stream in a downward direction through at least one flow passage of a brazed plate heat exchanger, a velocity of the downward flowing refrigerant stream being maintained to be at least 0.1 meters per second during cooling operation of the very low temperature refrigeration system; and flowing a refrigerant stream in an upward direction through at least one further flow passage of the brazed plate heat exchanger, a velocity of the upward flowing refrigerant stream being maintained to be at least 1 meter per second during cooling operation of the very low temperature refrigeration system.

In further, related embodiments, the downward flowing refrigerant stream may comprise a high pressure flow of the very low temperature refrigeration system and the upward flowing refrigerant stream may comprise a low pressure flow of the very low temperature refrigeration system. A header of the brazed plate heat exchanger may comprise an insert distributing liquid and gas fractions of refrigerant flowing through the header. The method may further comprise separating liquid refrigerant from a low pressure refrigerant stream exiting a warmest heat exchanger of the very low temperature refrigeration system using a suction line accumulator. The very low temperature refrigeration system may comprise a refrigeration duty compressor. The compressor may comprise a reciprocating compressor. The compressor may comprise a semihermetic compressor. A velocity of the upward flowing refrigerant stream may be maintained to be at least 2 meters per second during cooling operation of the very low temperature refrigeration system. A coldest heat exchanger in the system may have a length of at least 17 inches and no greater than 48 inches, or the two coldest heat exchangers in the system each may have a length of at least 17 inches and no greater than 48 inches, or the three coldest heat exchangers in the system each may have a length of at least 17 inches and no greater than 48 inches. At least one heat exchanger in the system may have a width of from about 2.5 inches to about 3.5 inches and a length of between about 17 inches and about 24 inches. At least one heat exchanger in the system may have a width of from about 4.5 inches to about 5.5 inches and a length of between about 17 inches and about 24 inches.

In another embodiment according to the invention, there is provided a method of reducing power consumption of a very low temperature refrigeration system that uses a mixed gas refrigerant. The method comprises determining when the very low temperature refrigeration system has excess cooling capacity; and reducing power consumption of a compressor of the very low temperature refrigeration system while still delivering a required amount of cooling capacity to a load. The reducing the power consumption comprises at least one of the steps selected from the group consisting of: (i) engaging a cylinder unloader of the compressor; (ii) varying a motor speed of the compressor; (iii) varying scroll spacing of a scroll compressor; and (iv) where the very low temperature system comprises more than one compressors in parallel, maintaining a first compressor of the more than one compressors in operation while turning off a second compressor of the more than one compressors or operating the second compressor at a reduced displacement.

In further, related embodiments, determining when the very low temperature refrigeration system has excess cooling capacity may comprise determining whether a return temperature from the load is more than a predetermined amount of temperature difference colder than a predetermined minimum temperature. Further, determining when the very low temperature refrigeration system has excess cooling capacity may comprise monitoring a percentage of time that a cool valve is open, or the percentage of time that a temperature control valve is open, and comparing the percentage of time with a predetermined percentage. Alternatively if a proportional valve is used then the amount that the proportional valve is opened can be used to correlate with the amount of excess capacity.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 8 is a screen shot of a status page from an implemented Web GUI in accordance with an embodiment of the invention.

DETAILED DESCRIPTION OF THE INVENTION

A description of example embodiments of the invention follows.

1. System and Method of Warming a Very Low Temperature Refrigeration System

In accordance with an embodiment of the invention, there is provided an improved system for achieving rapid warming of a cryogenic heat exchanger array used in a mixed gas refrigeration system in the very low temperature range. As used herein, "very low temperature" means the temperature range from 90 K to 203 K.

In accordance with an embodiment of the invention, there is provided a means to achieve a rapid warming of a heat exchanger array of a very low temperature refrigeration system. In one embodiment, a very low temperature system uses the existing refrigeration compressor to provide a source of high pressure hot gas or other high pressure gas at a room temperature or at an intermediate temperature, or at a high temperature, to warm the heat exchanger array of the refrigeration system. This may, for example, be controlled using a valve which controls where the warm gas is delivered within the heat exchanger array. Other warming methods are also provided. Heat exchanger warming techniques in accordance with an embodiment of the invention can reduce the warm-up time from the conventional 1 to 2 days to much shorter times, such as less than 6 hours, less than 4 hours, less than 3 hours, less than 2 hours, less than 1 hour, less than 30 minutes, less than 15 minutes and less than 5 minutes. An embodiment according to the invention manages the load on the compressor such that it does not draw an excessive amount of current and such that it does not cause a high pressure fault condition, a low pressure fault condition or any other normal faults in the system.

An embodiment according to the invention also provides a means for achieving warming of the heat exchanger that requires no external equipment and that does not require access to the sealed refrigeration system. For instance, an embodiment according to the invention can achieve rapid warming of the heat exchanger array using only internal valves of the refrigeration system. In addition, the system includes instrumentation and controls to determine when the heat exchangers have been warmed and to terminate the warming process.

An embodiment according to the invention uses the existing refrigeration compressor to provide a means of providing refrigerant that is at a substantially warmer temperature than that of the coldest heat exchangers when the system is operating under normal conditions, to the coldest heat exchanger or to the next coldest heat exchanger in order to achieve warming of all of the heat exchangers.

Figure 1:
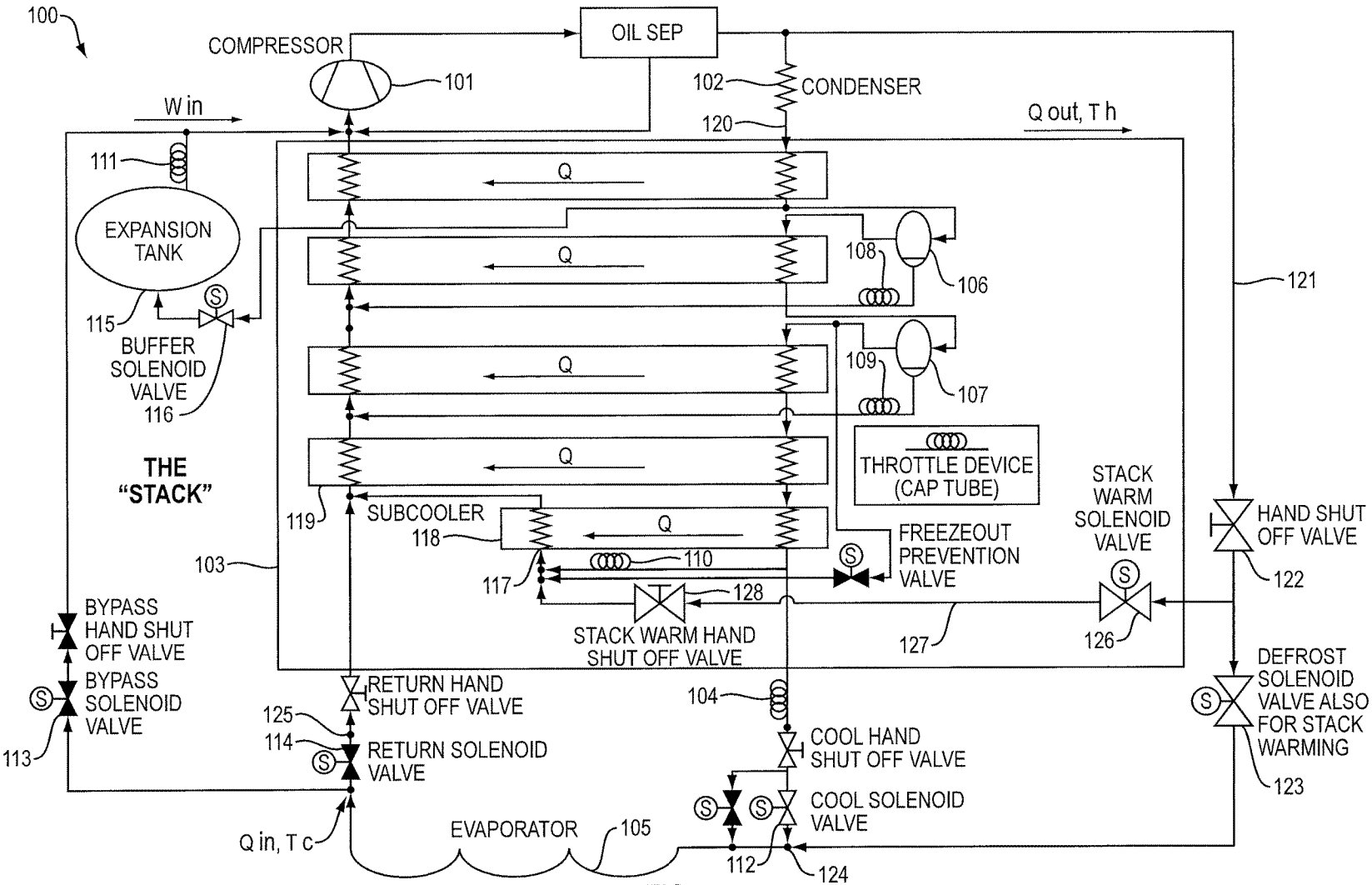
FIG. 1 is a schematic diagram of a refrigeration system incorporating a heat exchanger warming feature in accordance with an embodiment of the invention.

FIG. 1 is a schematic diagram of a refrigeration system incorporating a heat exchanger warming feature in accordance with an embodiment of the invention. An embodiment according to the invention warms an array of heat exchangers that is used to achieve cryogenic temperatures in a mixed refrigeration system. In particular, an embodiment according to the invention may be used in an autocascade refrigeration system 100 of FIG. 1. Such systems use a mixture of two or more refrigerants in which the difference between the normal boiling points from the warmest boiling component to the coldest boiling component is at least 50 K or 100 K or 150 K or 200 K. Such systems may include a refrigeration compressor 101, a condenser 102 or desuperheater heat exchanger for rejecting heat, a series of two or more heat exchangers 103 (also referred to herein as a "heat exchanger array" or "refrigeration process"), one or more throttle devices 104, and an evaporator 105 for heat removal. In addition, such systems may include phase separators 106, 107 which are positioned on the discharge side between heat exchangers and remove liquid phase refrigerant for use in an internal recycle loop. Such systems may have the ability to operate in different operating modes, including cool mode in which the evaporator 105 is cooled, defrost mode in which hot gas from the compressor 101 is supplied to the evaporator 105 and standby mode in which neither cold refrigerant nor hot refrigerant is delivered to the evaporator 105. Flow through various flow loops within the system may be controlled via a series of capillary tubes 108, 109, 110 and 111 which restrict flow and/or via on/off solenoid valves 112, 113, 114, and/or via partially or fully blocking flow into or out of the condenser 102. In the embodiment shown in FIG. 1, capillary tubes 108, 109, 110 and 111 are not associated with any solenoid valves, while capillary tube 104 is connected to solenoid valve 112. Other arrangements of capillary tubes and solenoid valves may be used. The capillary tubes and/or the solenoid valves can be replaced with a proportional valve such as a thermo expansion valve, or a pressure actuated or stepper motor actuated valve. Such systems may also contain an expansion tank 115 which is used to manage high evaporation and expansion of the liquefied refrigerants once the system is turned off and warmed to room temperature. Further, such systems with expansion tanks 115 may also have a solenoid valve which allows high pressure gas to be directed to the expansion tank. Such a valve, typically referred to as a buffer valve 116, allows the amount of refrigerant gas in circulation to be reduced which in turn reduces compressor discharge and suction pressures. An embodiment according to the invention may use any of the methods disclosed in U.S. Pat. No. 6,574,978 B2 of Flynn et al., the entire disclosure of which is hereby incorporated herein by reference. Systems as described in this patent enable additional operating modes such as controlled cool down and warm up processes, and extended operation in a hot gas flow mode, or bakeout mode, in which a portion of the hot gas exiting the compressor is continuously circulated from the compressor to the evaporator coil and then back to the compressor, while another portion of the refrigerant exiting the compressor continuously flows through the condenser and then the heat exchanger array and then returns to the compressor.

In an embodiment according to the invention, hot gas from the compressor 101 is routed either to the low pressure inlet 117 of the coldest heat exchanger 118, or to the low pressure inlet of the next coldest heat exchanger 119. For example, this diverting of refrigerant flow may be achieved using a stack warming solenoid valve 126 through a diverter loop 127. A stack warm hand shut-off valve 128 may also be present but is not required in normal operation. In alternate arrangements, room temperature refrigerant from the condenser outlet 120 is used as the source of warming refrigerant. In alternate arrangements, intermediate temperature high pressure refrigerant, from within the refrigeration process is used as the source of warming refrigerant. In some arrangements it may be beneficial to begin the warming process with one source of warming refrigerant and then to select a different source of warming refrigerant. In some cases it may be beneficial to have a sequence of two, three, or more different sources of warming gas sources, each with different temperatures and/or compositions. It may also be useful to have sequences where the source of warming refrigerant alternates between two or more different sources of warming refrigerant. In yet other arrangements, it may be useful to blend different sources of warming refrigerant, including to blend warming refrigerants having different temperatures and/or compositions. In such cases, it may be beneficial to vary the amount of warming refrigerant during the warming process. In addition to using one of more sources of refrigerant, it may also be beneficial to deliver warm refrigerant to more than one location in the heat exchanger array. Still further, it may be beneficial to divert refrigerant of a particular composition and of a low or intermediate temperature and exchange heat with a warmer temperature stream, and use the resulting, warmed diverted stream to provide the source of warming refrigerant.

In a refrigeration system in accordance with an embodiment of the invention, the buffer valve 116 is a connection between the discharge side of the unit and one or more expansion tanks 115, which is controlled by a solenoid valve. When a high pressure condition exists the control system opens this buffer unloader solenoid valve and allows a portion of the refrigerant to be stored in the expansion tanks 115, thereby reducing the discharge pressure. This can prevent an excessive discharge pressure fault condition.

In addition, in accordance with an embodiment of the invention, during warming sequences, the buffer valve 116 may be activated continuously to reduce compressor discharge pressure so that discharge pressure faults are avoided. This may be done as part of an intentionally-activated service mode of the system. Continuous activation of the buffer valve 116 reduces the refrigeration effect of the normal refrigeration process which results in a shorter time to warm the system. Another benefit of continuous activation of the buffer valve 116 is to reduce the accumulation of liquid refrigerant in the phase separators 106, 107. This prevents flooding of the phase separators 106, 107 which can allow excess amounts of compressor oil or warm boiling refrigerants to migrate to the cold end of the system and cause subsequent reliability problems. Alternatively, the buffer valve 116 can be activated in a pulsed manner so as to achieve these same benefits. Such benefits would be assessed based on the avoidance of high pressure faults, the compressor current remaining under the maximum allowable value, the avoidance of phase separator flooding, and the achievement of rapid warming of the heat exchanger array 103. Pulsing of the buffer valve 116 may be used in place of continuous activation of the buffer valve, wherever such continuous activation is discussed herein. Alternatively a solenoid valve may also be used on the suction side connection to the expansion tank 111 to close off the suction connection. This would eliminate the need to keep the buffer unloader valve 116 open continuously. In some cases it is expected that even with the suction return connection 111 closed, that the discharge side pressure will rise as the stack warming progresses and that it will be necessary to periodically open the buffer unloader valve 116.

In another embodiment the buffer valve activation is delayed during this warming mode until the compressor suction pressure increases above a designated minimum suction pressure threshold, provided there is no risk for high pressure faults. One of the main reasons an operator may run this warming process is to check for the possibility of a leak. If a significant leak has occurred then delaying the buffer valve activation can prevent a low suction pressure condition which can lead to a fault. In alternate arrangements the buffer valve is cycled based on the discharge pressure, the suction pressure or a combination of both the discharge pressure and the suction pressure.

In another embodiment according to the invention, a normal hot gas defrost system 121 of the very low temperature system may be used to achieve warming of the heat exchanger array, along with additional features of an embodiment according to the invention. The normal hot gas defrost system includes a hand shut-off valve 122 and a defrost solenoid valve 123, and directs hot gas from the compressor 101 to the inlet 124 of the customer feed line which sequentially flows through the feed line, the customer cryocoil or cryosurface 105, the return line 125 and then through the low pressure side of the heat exchanger array 103. Normally the hot gas defrost system terminates when the return temperature at the unit reaches a temperature between −20 C and +40 C. However, this does not result in significant warming of the stack since many portions of the heat exchanger array 103 will remain at temperatures below −80 C at this condition. In addition, if this process is allowed to continue beyond this set point the normal experience is that high discharge pressure faults will occur. Further, in such cases reliability problems are encountered due to excessive migration of compressor oil past the phase separators.

In an embodiment according to the invention, the hot gas defrost circuit 121 is allowed to continue operation past the normal temperature limit on the return line 125. In order to avoid high discharge pressure problems the buffer valve 116 is activated continuously along with the hot gas defrost valve 123 after the normal return line set point temperature is reached and preferably is activated continuously along with the hot gas defrost valve 123 during the normal portion of the defrost process. Continuous activation of the buffer valve 116 provides the benefit of reducing the compressor discharge pressure. This in turn reduces the level of liquid refrigerant in the phase separators 106, 107 and avoids the flooding of such phase separators which can cause migration of compressor oil to the coldest parts of the system and cause loss of cooling performance.

In accordance with one embodiment of the invention, the hot gas defrost circuit 121 may be used alone up until the normal temperature limit on the return line 125 is reached, and then, after that point, may be used with the buffer valve 116 open. Alternatively, the hot gas defrost circuit 121 may be used while having the buffer valve 116 open from the beginning of operation of the hot gas defrost circuit 121. In another embodiment according to the invention, the hot gas defrost circuit 121 may be used as normal until the normal temperature limit on the return line 125 is reached, and then, after that point, a stack warming solenoid valve 126 and diverter loop 127 may be used for warming.

In accordance with an embodiment of the invention, the possibility of freezeout of refrigerant that is discharged from the compressor, and that is being directed to a colder point in the system, may be addressed. Such refrigerant that is being discharged from the compressor may have a higher risk of freezeout because it has not yet passed through the phase separators in the system, and therefore has a different composition than later in the refrigeration process, and thus may have a warmer freezing point and be more likely to freezeout when directed to a colder point in the system. To prevent such freezeout, an embodiment according to the invention may use a freezeout prevention circuit or temperature control circuit, which uses a controlled bypass flow to warm the lowest temperature refrigerant in the system, to warm the stack sufficiently that the refrigerant discharged from the compressor does not freezeout when redirected to a colder point in the system. For example, any of the freezeout prevention circuits or temperature control circuits may be used that are disclosed in U.S. Pat. No. 7,478,540 B2 of Flynn et al., the entire disclosure of which is hereby incorporated herein by reference. The stack may be warmed prior to redirecting the compressor discharge gas to a colder point in the system, using either a freezeout prevention valve or a temperature control valve. The freezeout prevention valve can be opened continuously to achieve warming of the stack. Alternatively, the temperature control valve can be used to deliver refrigerant from, for example, the vapor outlet of the coldest phase separator in the system, to a different valve that delivers the refrigerant to a point near the cold end of the system, such as the cryocoil inlet, the cryocoil return, or both. This allows the stack to warm sufficiently that the compressor discharge gas will not freeze out when redirected to a colder point in the system.

In accordance with an embodiment of the invention, the refrigeration system may include a series of internal return paths 108, 109, 110 from the high pressure side of the system to the low pressure side in addition to the return path via the evaporator 105. During the heat exchanger warming process flow to the evaporator 105 will typically be stopped. However, in other scenarios flow to the evaporator is allowed to continue. Typically the internal return paths 108, 109, 110 are throttle devices. Example throttle devices are capillary tubes and thermal expansion valves. In other scenarios, turbo expanders or other means to reduce the pressure of the refrigerant are used. In a typical warming process the internal throttle devices 108, 109, 110 are allowed to have flow. In other scenarios their flow rate is stopped or controlled. In one example, capillary tubes may be used for the internal throttle devices 108, 109, 110 with no upstream valves. As a result these throttle devices continue to flow during the warming process.

In accordance with an embodiment of the invention, during the warming process there are two significant constraints which must be managed. The refrigeration compressor 101 is limited by the amount of current it can draw. This current is a function of the nominal rated load of the compressor 101, the compressor suction pressure, compressor discharge pressure, the refrigerant used and the inlet temperature of the refrigerant. However, of all these, the main factor affecting current draw is compressor suction pressure. The discharge pressure also has an effect but is typically less significant than the suction pressure. The other factors are significant but typically do not result in significant variation. As the system is warmed up the compressor suction pressure will tend to rise. In addition, as the refrigerants warm the gases will expand and liquid phase refrigerant will evaporate. These effects result in a significant amount of refrigerant gas which must be managed. In particular the combination of high suction pressure and high amount of gas pressure in the system is likely to result in high discharge pressure. A high pressure condition can result in a high pressure fault which will shut the system down.

In accordance with an embodiment of the invention, one method to manage the excess gas load is to make use of the expansion tanks 115, and/or buffer tanks if the system has them (a buffer tank, not shown, is a volume connected to the high pressure side of the system). If the system has a buffer valve 116 connecting from the high pressure side of the system to the expansion tank 115 it can be energized during the entire process. This limits the amount of gas in circulation and limits compressor amperage draw and the discharge pressure.

In addition, in accordance with an embodiment of the invention, the gas warming solenoid valve 126 and connecting tubing may be sized in a way that achieves an adequate flow rate. In the case of internal throttles 108, 109, 110 without solenoid or hand shut off valves, the internal refrigerant flow will continue to occur and cool the heat exchangers, during a warming process. The resulting flow through these throttle devices 108, 109, 110 also provides a minimum compressor suction pressure. The opening of the gas warming solenoid valve 126 provides an additional flow path and correspondingly increases the compressor flow. This warm flow also provides warming to the heat exchangers 103. Thus there are two competing factors occurring: internal throttle flow, which can cool the heat exchangers 103, and warm gas flow, which can warm the heat exchangers 103. In order to effectively warm the heat exchangers the warm gas flow should be sufficient to overcome the cooling effect of the internal throttles 108, 109, 110. However, the warm gas flow should not become excessive or it will result in excessive compressor current. Also, excessive flow can cause the compressor to operate under conditions which can jeopardize reliability. In addition, the refrigerant/oil separators operate at reduced efficiency at excessive flow rates.

In accordance with an embodiment of the invention, if it is not possible to get sufficient warm gas flow to overcome the cooling effect of the internal throttles 108, 109, 110, with the above constraints then some of the internal throttles 108, 109, 110 may be modified so that their flow rate can be reduced or eliminated or regulated during the warming process. In an alternate arrangement all of the internal throttles 108, 109, 110 are closed during the stack warming. In yet an alternate arrangement none of the internal throttles 108, 109, 110 are closed during the stack warming. In yet an alternate arrangement at least one of the internal throttles 108, 109, 110 are closed during the stack warming. In yet an alternate arrangement at least one of the internal throttles 108, 109, 110 are fully or partially closed for a portion of the stack warming process. In another arrangement, flow into or out of the condenser 102 may be fully or partially blocked, instead of, or in addition to, fully or partially closing at least one of the internal throttles 108, 109, 110.

An embodiment according to the invention eliminates the need for an external compressor for warming a heat exchanger array 103. This allows a refrigeration system to be enabled with a warming feature using relatively inexpensive parts, such as stack warming solenoid valve 126 and diverter loop 127. Depending on the plumbing arrangement employed, it is possible to direct flow through all heat exchangers 103 in the system and to warm both the suction side and discharge side plumbing. Flow may be provided to a subcooler heat exchanger 118. Also, flow and/or warming may be provided to the discharge side connections between heat exchangers, which may include the phase separators 106, 107.

Figure 2:
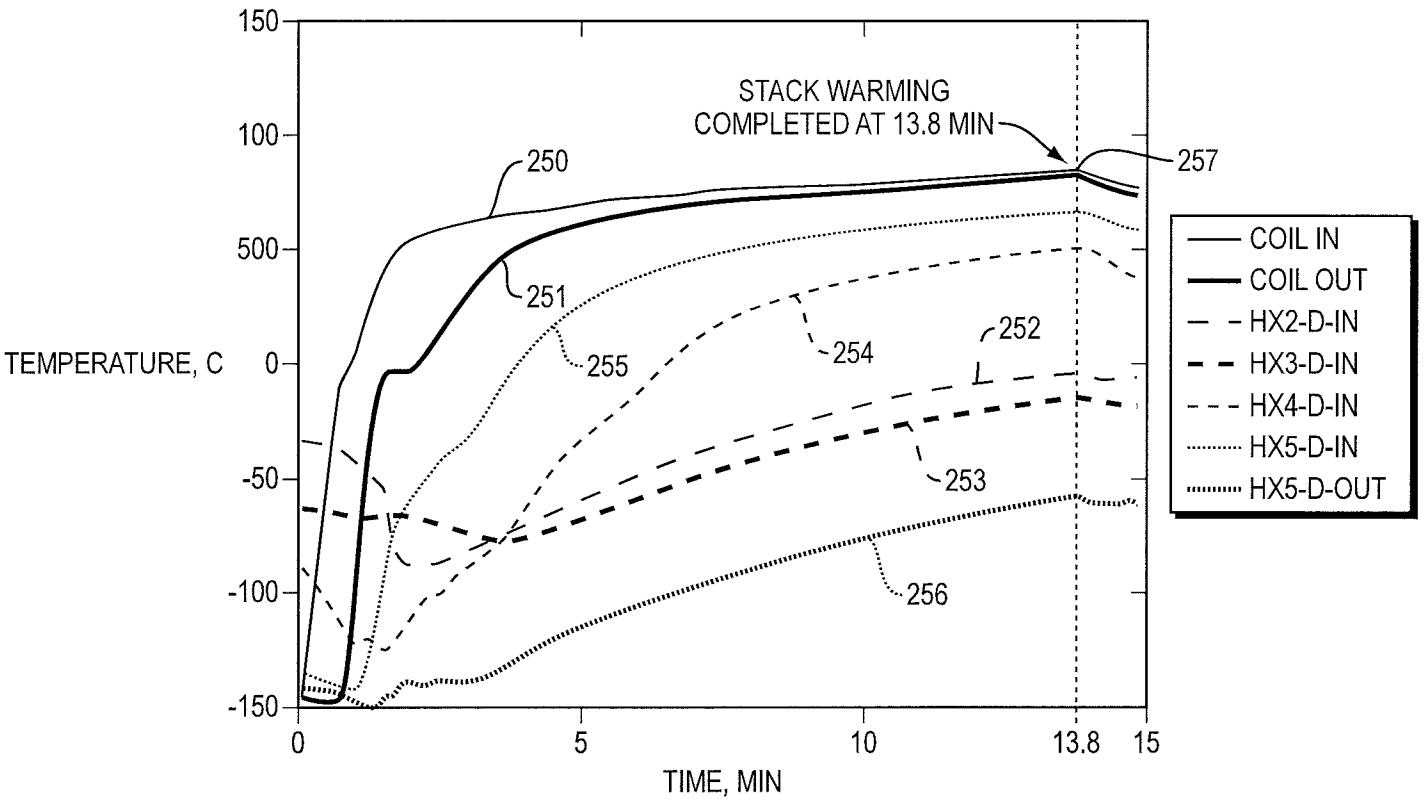
FIG. 2 is a graph of temperatures in a refrigeration system during stack warming in accordance with an embodiment of the invention.

FIG. 2 is a graph of temperatures in a refrigeration system during stack warming in accordance with an embodiment of the invention. In this instance, the extended defrost 121 technique discussed above was used. Here, there are shown the input temperature of the coil 250, the output temperature of the coil 251, the temperature of the second heat exchanger discharge side input 252, the temperature of the third heat exchanger discharge side input 253, the temperature of the fourth heat exchanger discharge side input 254, the temperature of the fifth heat exchanger discharge side input 255, and the temperature of the fifth heat exchanger discharge side output 256. As can be seen, stack warming is completed within as rapid a time as 13.8 minutes, shown at point 257, at which point at least one of the heat exchanger inputs 252-255 has reached a temperature above 20 C, or another set point temperature. Here, for example, heat exchanger measurements 254 and 255 have both reached a temperature above 50 C, and heat exchanger measurements 252 and 253 have both reached temperatures above −50 C, by the 13.8 minute mark. Using warming in accordance with an embodiment of the invention, at least a portion of the heat exchanger array may be warmed from a temperature in the very low temperature range to a warmer temperature such as at least about 5 C, at least about 10 C, at least about 15 C, at least about 20 C, at least about 25 C, at least about 30 C and at least about 35 C.

Figure 3:
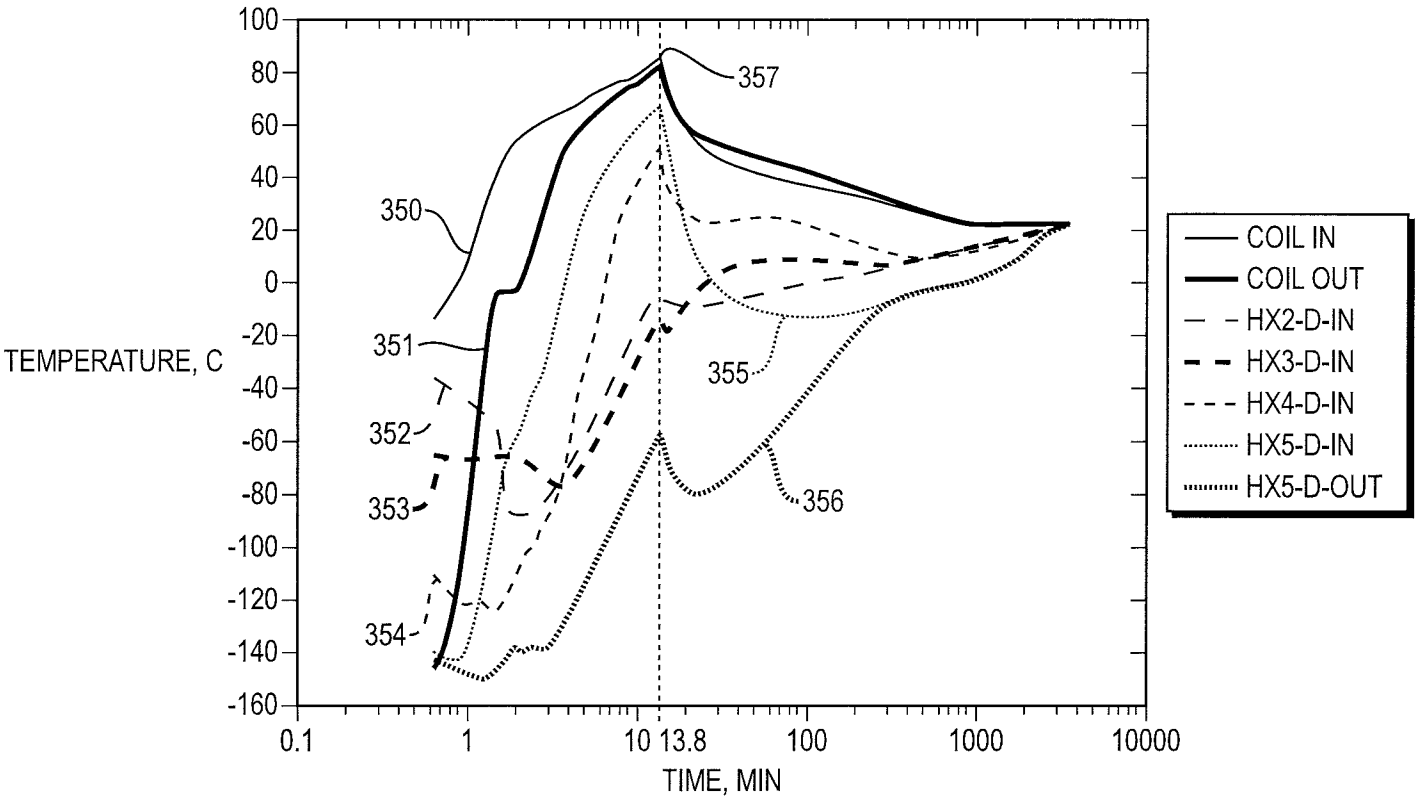
FIG. 3 is an extended version of the graph of FIG. 2, on a logarithmic timescale, in accordance with an embodiment of the invention.

FIG. 3 is an extended version of the graph of FIG. 2, on a logarithmic timescale, in accordance with an embodiment of the invention.

Figure 4:
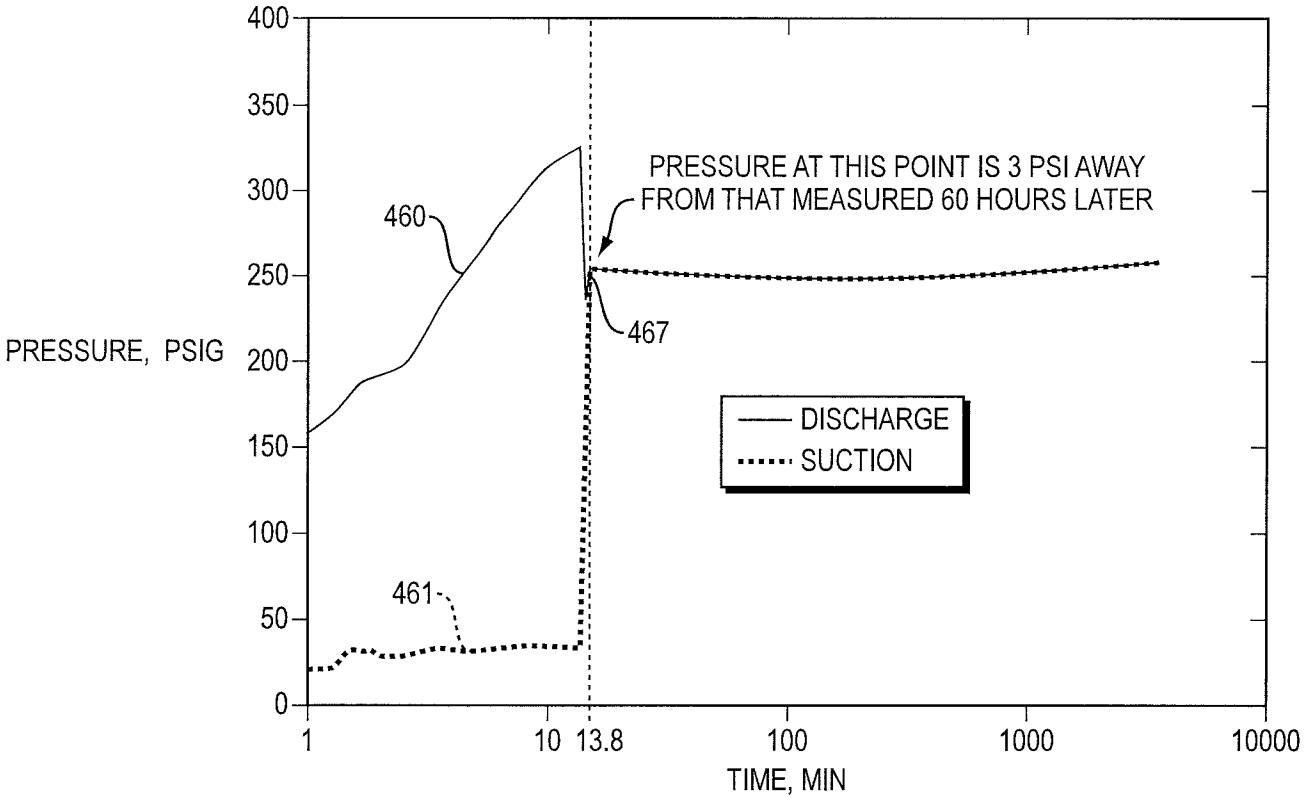
FIG. 4 is a graph of pressure profiles during and after stack warming in accordance with an embodiment of the invention.

FIG. 4 is a graph of pressure profiles during and after stack warming in accordance with an embodiment of the invention. A high pressure 460 and low pressure 461 of the refrigeration system are collapsed to be approximately equal at 13.8 minutes (point 467) when the compressor is shut off due to adequate warming of the stack. The balance pressure point is the point where the high pressure 460 and low pressure 461 of the system are equal, or approximately equal—here, the pressure at point 467 is only 3 psi away from that measured 60 hours later. In this case, an embodiment according to the invention permits a balance pressure check after as little as 13.8 minutes.

In addition, an embodiment according to the invention permits the balance pressure that is achieved using stack warming to be close to the natural warm-up balance pressure of the system, which can vary based on the condition that the system was in when it was turned off. For instance, the balance pressure achieved using stack warming may be within about 5 psi, 10 psi, 20 psi or 30 psi of the typical natural balance pressure. As used herein the "natural balance pressure" means a pressure achieved when the high pressure and low pressure of the system are equal, or approximately equal, and that would be achieved by the system upon warming up in the absence of stack warming in accordance with an embodiment of the invention; for example when the stack is warmed such that the average heat exchanger array temperature is at least as warm as a temperature from the group consisting of −5 C, 0 C, 5 C, 10 C, 15 C, 20 C, 25 C, 30 C, 35 C, 40 C; or for example when the heat exchanger array is warmed such that the range of temperatures in the stack is from at least −5 C up to 40 C, or is a smaller range within the range of −5 C to 40 C.

An embodiment according to the invention may also be used to warm the heat exchanger array to a temperature that is warmer than is needed for a balance pressure check, in order to ensure that all parts of the system are warm quickly. This may be advantageous, for example, if it is desired to fully remove refrigerant charge from the system in preparation for a recharge.

Figure 5:
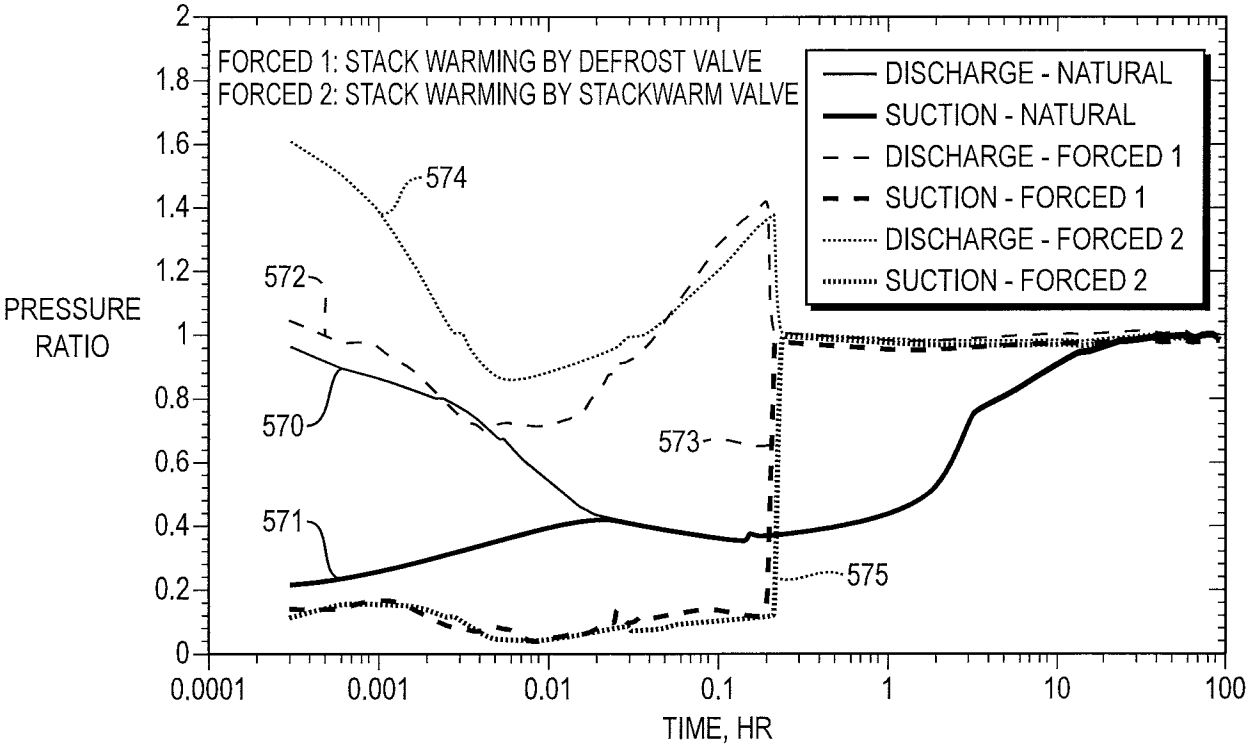
FIG. 5 is a graph comparing pressure profiles of a refrigeration system warmed using three different techniques: natural stack warming; stack warming using a diverter stack warmer in accordance with an embodiment of the invention; and stack warming using an extended operation of defrost loop in accordance with an embodiment of the invention.

FIG. 5 is a graph comparing pressure profiles of a refrigeration system warmed using three different techniques: 1) natural stack warming; 2) stack warming using a diverter stack warmer 126/127 in accordance with an embodiment of the invention; and 3) stack warming using an extended operation of defrost loop 121 in accordance with an embodiment of the invention. Shown are the natural discharge pressure 570, natural suction pressure 571, discharge pressure 572 using extended defrost, suction pressure 573 using extended defrost, discharge pressure 574 using a diverter stack warmer, and suction pressure 575 using a diverter stack warmer. It can be seen that the system pressure with the compressor off is approximately equal to the ultimate system pressure when fully warmed to room temperature, and can be achieved in less than 1 hour using both techniques in accordance with an embodiment of the invention, but cannot be achieved within 10 hours using natural stack warming. An embodiment according to the invention permits an improved time to service for a very low temperature refrigeration system, by virtue of both warming the stack more quickly as discussed herein, and permitting a shorter time to balance pressure check as discussed herein.

In accordance with an embodiment of the invention, one or more sensors may be used to determine when to shut off the warming system based on a temperature setpoint provided to a control system, not shown. The sensors may, for example, be thermocouples brazed onto one or more locations in the heat exchanger array 103. For example, the discharge inlet to or discharge outlet from one or more heat exchangers, or the suction inlet to or suction outlet from one or more heat exchangers, may be used as locations for temperature sensors. In one example, a discharge outlet from a second heat exchanger (away from the compressor) may be used. In another example, other temperature sensors are used, such as silicon diodes or other similar devices.

In accordance with an embodiment of the invention, it should be appreciated that various different possible techniques of diverting warm gas, including those discussed herein and others, may be used. Also, various different possible techniques may be used to reduce mass flow of refrigerant through the compressor. While the use of a buffer unloader valve has been discussed herein, it is also possible to use other techniques to reduce mass flow while using the diverting of warm gas. For example, a regulator valve could be used on the inlet of the compressor; a variable speed drive could be applied to the compressor; a cylinder-unloader could be used to block mass flow into the cylinders to reduce the effective displacement of the compressor; where a scroll compressor is used, a device may be used to separate the orbiting or stationary scrolls from each other, thereby reducing the compressor's efficiency; and, where multiple compressors are used, the mass flow of one may be reduced or one or more of the compressors may be shut off entirely. In one example of regulating the compressor suction pressure, an electrically driven or pneumatically controlled valve such as a crank case pressure regulating valve may be used in order to reduce mass flow of refrigerant through the compressor. The crank case pressure regulating valve can act as a governor, controlling the downstream pressure at the compressor; and can have an internal pressure regulating capability or be part of a pressure regulating system that includes pressure sensors, logic and pressure control valves.

In accordance with an embodiment of the invention, methods of preventing excessive compressor mass flow need not reduce the flow as compared with normal cool operation. In some cases the mass flow will be higher than in normal cool operation. In accordance with an embodiment of the invention, preventing excessive compressor mass flow achieves warming of the heat exchanger array without generating a fault due to excessive compressor current, excessive discharge pressure, or other malfunction that could be caused by excessive flow rates. More generally, a system in accordance with an embodiment of the invention has provision to allow warming the heat exchanger array in a manner that prevents excessive flow through the compressor such that improper operation is not experienced. For example, problems associated with typical compressor faults may be avoided, such as: low suction pressure, excessive compressor amperage, excessive discharge pressure, excessive compressor mass flow (which could result in excessive amperage or such that oil separator efficiency becomes compromised) and excessive discharge temperature.

In accordance with an embodiment of the invention, techniques of extended defrost 121 and stack warming with a diverter 126/127 may be used separately or together. The stack warmer with a diverter has the advantage of being able to be used when flow to the evaporator 105 is shut off. As used herein, except where otherwise specified, the term "diverting" and a "diverter" may include use of the defrost line 121 to permit warming of the heat exchanger array, as well as including the use of a diverter 126/127.

2. Compact and Efficient Refrigeration System

In another embodiment according to the invention, there is provided a refrigeration system that is physically compact and that operates efficiently. The system includes a suction line accumulator that separates liquid refrigerant from the low pressure stream exiting the warmest recuperative heat exchanger and remixes this separated liquid with the vapor portion of the low pressure stream so as to prevent excessive return of liquid refrigerant to the compressor at any one time. The system may also include recuperative heat exchangers in which there is at least one additional stream which is different from either the high pressure or low pressure refrigerant. The system may also include heat exchangers which flow only the high pressure refrigerant or the low pressure refrigerant, and in which heat is transferred with at least one other stream which is different from either high or low pressure refrigerant.

In accordance with an embodiment of the invention, heat exchangers are used that assist in providing a physically compact system that operates efficiently. Traditionally, long tubes of copper were assembled to form counterflow heat exchangers. Typical lengths varied from 5 feet to 50 feet and consisted of one or more inner tubes inserted into a larger tube. Normally the inner and outer tubes were smooth without any surface enhancements. However, alternate designs include the use of surface features on the inside or outside of the tubes to enhance heat transfer, or the use of a fluted tube for the inner tube. One refrigerant stream flowed through at least one of the inner tubes and another flowed in the annular space between the inner and outer tubes. On larger systems, i.e., ones with compressor displacements of 4 cfm and higher, a typical very low temperature refrigeration system could have up to 5 or more of these heat exchangers. Due to the changes in refrigerant density from the outlet of the condenser to the outlet of the coldest heat exchanger, the physical dimensions of the tube diameters varied, with smaller diameters being better suited for the lower temperatures to ensure good velocities for effective heat transfer, provided that the pressure drop is not excessive.

In addition, in conventional systems, the presence of phase separators reduces the mass flow to the colder heat exchangers and also results in a need to reduce tube diameter for the colder heat exchangers. Two significant disadvantages exist with the use of these tube in tube heat exchangers. One is physical size. Tube type heat exchangers are typically required to be coiled to keep their overall size compact. However, even with coiling the resulting heat exchanger size is relatively large. Another disadvantage of tube in tube heat exchangers is the relatively high pressure drop. Although some level of pressure drop is useful and even necessary, it represents an inefficiency in the system. On the high pressure side it reduces the refrigeration potential that the expander can achieve since a portion of the pressure potential provided by the compressor is lost. On the low pressure side it reduces the refrigeration effect generated by the expansion process and results in warmer temperatures on the low pressure side. Therefore a high efficiency design should seek to minimize pressure drop. Tube in tube heat exchangers have been observed to lose up to one third of the compressor's differential potential on the high pressure side, and up to 12% on the low pressure side.

In accordance with an embodiment of the invention, a very low temperature refrigeration system uses brazed plate heat exchangers to replace conventional tube in tube heat exchangers. The benefit of the brazed plate heat exchangers is that they provide more parallel paths than are practical in a tube in tube arrangement. This reduces the travel path through each heat exchanger and reduces pressure drop. This improves overall system efficiency since the percent of compressor differential pressure lost to heat exchanger pressure drop is reduced.

In accordance with an embodiment of the invention, brazed plate heat exchangers are used with certain minimum velocities, which ensure good heat transfer. In addition, high efficiency is not realized if velocities are kept too high such that high pressure drops occur. In accordance with an embodiment of the invention, a minimum velocity for the downward stream of 0.1 m/s is used, and a minimum velocity of 1 to 2 m/s for vertical upward flow is used (where "downward" and "upward" are relative to the gravitational field). Other minimum velocities may be used; for example, a minimum velocity for the downward stream of 0.5 m/s or 0.2 m/s may be used, and a minimum velocity for the vertical upward flow of 0.5 m/s, 3 m/s or 4 m/s may be used. Typically, the high pressure flow will be the downward flowing stream and that the low pressure flow will be flowing vertically upward; however, different flow directions may be used provided that the minimum velocities are maintained. If the minimum velocities are not met there is a risk of liquid refrigerant accumulating excessively in the heat exchangers and causing a loss of heat transfer. Without wishing to be bound by theory, and although there may be several mechanisms here, one way to think of this is that the accumulated mixture begins to act as a fixed thermal mass and this can result in a "thermal short" between the temperature potentials of the heat exchanger. This results in a significant reduction in heat exchanger effectiveness relative to what one would expect of a counter flow heat exchanger.

In accordance with an embodiment of the invention, for those heat exchangers that have a significant liquid fraction entering with gas, care should be taken to ensure that the two phases are kept well blended in the header portion of the heat exchanger so that the two phases are reasonably well distributed between the various parallel flow paths. This may be performed using an insert placed into at least one flow passage of a header of the heat exchanger to distribute liquid and gas fractions of the refrigerant flow. For example, the refrigerant flow may be distributed by any of the systems and/or methods disclosed in U.S. Pat. No. 7,490,483 B2 of Boiarski et al., the entire disclosure of which is hereby incorporated herein by reference.

In accordance with an embodiment of the invention, maintaining minimum flow velocities results in a need to minimize the number of plates in the heat exchanger, for a heat exchanger of a given width. This can have the impact of requiring additional heat exchangers, or the need to select heat exchangers with a longer flow path since the amount of heat transfer area may be limited due to the need for minimum velocities. The need to manage two phase flow when entering the heat exchangers requires additional hardware which makes the use of additional heat exchangers more costly. As a result, the preference is to select heat exchangers with a longer flow path. As an example some typical heat exchangers are available in different lengths while maintaining the same or similar widths. As used herein, the "length" of a brazed plate heat exchanger is the distance from the inlet end to the outlet end for a single pass heat exchanger that is being referenced. This refers to the nominal external dimensions. In normal use with two phase flow, the length extends in the vertical direction with high pressure fluid flowing in the vertical down direction and low pressure fluid flowing in the vertical up direction. The actual fluid path distance, as measured from inlet port to outlet port, on a single pass arrangement, will necessarily be shorter than the external length dimension. Other dimensions referenced herein are the width and depth. The "width" is defined by the distance across the heat exchanger and is nominally the width of the stamped plates that form the heat exchanger. The "depth" is a function of how many plates are stacked together and their respective depths combined with the depths of the end plates. Example lengths of some typical available heat exchangers are 10 to 12 inches and 17 to 22 inches and 30 to 48 inches. The challenge of maintaining minimum velocities and achieving adequate heat transfer is more significant for the colder heat exchangers. In accordance with an embodiment of the invention, the coldest heat exchanger in the system has a length of at least 17 inches and no greater than 48 inches. In an alternate embodiment the two coldest heat exchangers have a length of at least 17 inches and no greater than 48 inches. In a further embodiment of the invention the three coldest heat exchangers have a length of at least 17 inches and no greater than 48 inches. In accordance with an embodiment of the invention, having a minimized width in combination with a greater length is preferred. For example, selecting a heat exchanger with a given width (for example, 5 inches) in combination with a length of 17 inches is preferred to a 5 inch wide heat exchanger with a length of 12 inches or less. This is because the longer flow path results in more surface area for heat transfer and allows the number of plates to be minimized, which in turn allows higher fluid velocities to be maintained for a given heat exchanger surface area. For example, a 2.5 inch to 3.5 inch width in combination with a length of at least 17 to 24 inches, or a 4.5 inch to 5.5 inch width in combination with a length of at least 17 to 24 inches may be used.

Further, in accordance with an embodiment of the invention, a suction line accumulator may be used with one or more brazed plate heat exchangers. This may be helpful because it is possible for liquid refrigerant to be returned to the compressor much more quickly on a system with brazed plate heat exchangers. A suction line accumulator therefore may help to ensure good management of returning liquid such that the compressor reliability is not jeopardized. Optionally the suction line accumulator may be omitted if signs of high rates of liquid return to the compressor are not observed.

In accordance with an embodiment of the invention, an efficient refrigeration system is further achieved by using a compressor that operates efficiently at the required pressures and compression ratio. An embodiment according to the invention may use a refrigeration duty (as opposed to air conditioning duty) semi hermetic reciprocating compressor. Such compressors tend to be optimized for use in various compression ratio applications. For example air conditioning compressors are designed for use in low compression ratio applications and can have a relatively high re-expansion volume. In contrast, higher compression compressors employ methods to reduce re-expansion volume. Scroll compressors face similar challenges, although in this case the geometry of the scroll members dictates the preferred compression ratio. Operation away from these optimized points results in inefficiencies which increase with increased deviation from the optimized operating compression ratio.

In accordance with an embodiment of the invention, a very low temperature refrigeration system may be configured to flow a refrigerant stream in a downward direction through at least one flow passage of a brazed plate heat exchanger, a velocity of the downward flowing refrigerant stream being maintained to be at least 0.1 meters per second during cooling operation of the very low temperature refrigeration system; and may be configured to flow a refrigerant stream in an upward direction through at least one further flow passage of the brazed plate heat exchanger, a velocity of the upward flowing refrigerant stream being maintained to be at least 1 meter per second during cooling operation of the very low temperature refrigeration system. The system may be configured for other flow velocities as discussed above. The downward flowing refrigerant stream may comprise a high pressure flow of the very low temperature refrigeration system and the upward flowing refrigerant stream may comprise a low pressure flow of the very low temperature refrigeration system. A header of the brazed plate heat exchanger may comprise an insert distributing liquid and gas fractions of refrigerant flowing through the header. The system may be further configured to separate liquid refrigerant from a low pressure refrigerant stream exiting a warmest heat exchanger of the very low temperature refrigeration system using a suction line accumulator. The very low temperature refrigeration system may comprise a refrigeration duty compressor. The compressor may comprise a reciprocating compressor or a semihermetic compressor. The system may be configured such that a velocity of the upward flowing refrigerant stream is maintained to be at least 2 meters per second during cooling operation of the very low temperature refrigeration system.

3. Method of Preventing Condensation on a Cold Valve Access Panel

In accordance with another embodiment of the invention, there is provided a method of eliminating or preventing condensation on a service access panel to a cold valve enclosure.

In conventional systems, a problem arises due to very low temperature fluid flowing through valves and associated tubing, and the need to make these valves accessible for service via an access panel. A combination of conduction and natural convection results in significant cooling of the cold valve box lid, which can lead to condensation and frost formation. The source of moisture for the condensation and frost is atmospheric humidity.

Conventional cold valve enclosures made use of layers of insulation. However, these have proved inadequate in prevention of condensation.

An embodiment according to the invention provides a method of preventing or reducing the formation of frost. The cold valve box assembly is completely insulated except for the front flange and the interior of the cold valve box. The back side of the flange, and the outside surfaces of the cold valve box sides and back panel are fully insulated and do not pose a moisture problems. This problem could potentially be solved by adding a sufficiently thick layer of insulation material. However, this requires several inches of insulation which is not practical. It also requires some tool access to be able to remove the lid and these access points become potential condensation points. Further, without active heating there is a risk that the lid could become frozen in place due to frost formation which can result in significant delays when servicing the valves.

In accordance with an embodiment of the invention, a first method involves running a tube trace 676 around the edge of the cold valve box enclosure. The tube 676 has hot gas running through it. The hot gas is driven passively by creating a parallel path on the discharge line of a refrigeration system. The diameter and length of the tubing 676 are sized to take advantage of existing pressure drop in the main discharge line. This allows a portion of the flow to "take the path of least resistance" and to flow through this tube trace 676 around the cold valve enclosure 677. Alternate embodiments of the invention include a hot gas bypass in which a portion of the compressor discharge gas flows through the hot trace 676 and then returns to the compressor suction. In another embodiment of the invention hot gas from the compressor discharge flows through the hot trace 676 and then mixes with high pressure refrigerant down stream of the condenser. In a further embodiment of the invention the rate of gas flowing in the bypass is regulated with a valve based on temperature feedback from a representative temperature of the flange and or lid. The heat trace tube 676 is thermally bonded to the edge of the cold valve enclosure 677 using mechanical clamps and heat transfer grease. There can be several ways in which the heat trace tube 676 is thermally bonded to the cold valve box or lid. One method is to use a film of thermal grease, preferably over a short distance to provide a thermal path between the tube and the box or lid. Alternatively the tube could be simply pressed onto the box or lid. Other options include other thermal conduction media such as materials with relatively high conductivity such as copper or aluminum. The location to which the tube 676 is attached is selected to allow heat to flow to the cold valve enclosure access panel and to minimize heat that enters into the cold valve enclosure 677. The elements in the thermal path between the hot gas tube trace 676 and the lid are: the hot gas tube, the wall of this tube, the thermal grease or other thermal bonding means, the walls of the cold valve enclosure to the cold valve box flange and the first parallel path of the gasket material between the flange of the cold valve enclosure 677 and the lid, and the second parallel path of the fastening hardware that compresses the lid to the gasket. Once heat is transferred to the lid it must be distributed to prevent cold spots. This is managed in one of two ways. One way is to use a highly conductive material for the lid, such as aluminum to achieve good thermal conduction across the lid. The other way is to use thermal insulation both on either the inside surface of the lid, the outside surface of the lid, or both. Alternate constructions have the hot gas trace 676 connected directly to the back side of the cold valve box lid, or attaching the hot tube trace 676 to another structure that selectively connects to the flange, or one in which contact to the flange is minimized in favor of thermal contact more directly to the cold valve box lid. Thermal insulation is placed on the inside of the lid to reduce convection to the lid. In addition, adding insulation to the outside of the lid is desirable to allow heat being added to the edge to be able to conduct to center regions which might be colder. Insulation may also be needed on the interior side walls of the cold valve box to limit the amount of heat entering the cold box from the heat trace. Further, the sizing of the hot trace bypass and the thermal contact needs to consider the wide range of operating conditions of the unit and ensure that the flow is sufficient to warm the lid without resulting in excessive temperatures which might injure service personnel. Although one or more embodiments include insulation, the amount of insulation required when a hot trace is used is significantly thinner than the insulation required if no active heating is present. As an example, the required insulation to prevent condensation may be 4 inches, 6 inches or even 12 inches thick when no active heating is present. In contrast, the use of active heating can eliminate the need for any insulation or may limit it to a thickness of only ½ inch or 1 inch.

In another embodiment of the invention, a second method uses an electric heater to heat a portion of the lid, or the entire lid. In this case thermal insulation is used on the inside of the lid and optionally on the outside of the lid. If the heater size is smaller than the lid then a highly conductive material is preferred to conduct heat across the lid. As in the first method insulation is added to the inside of the lid. Insulation may also be used on the outside of the lid as well to ensure that the heat from the heater goes to the lid and not to the surrounding air. It may also be necessary to place some insulation over the heater. However, if this is done care must be taken to ensure that the heater can never reach temperatures exceeding the limits of the insulating material or of the heater. Independently, design with a heater should include a consideration of potential excessive temperatures. Where this is a realistic possibility a safety thermostat or other temperature limiting element should be part of the design.

A hot gas trace method in accordance with an embodiment of the invention uses hot gas from the compressor; uses only a portion of the flow and controls this passively by balancing flow resistance; delivers the correct amount of heat to prevent condensation without providing excessive heat such that service personnel would be endangered; and does not deliver excessive heat to the cold valve box which would otherwise decrease the overall efficiency of the system. In an example of tests on systems in accordance with an embodiment of the invention, for tested systems that used a 10 HP compressor, the required heating of the cold valve box, which had dimensions of about 18 inches wide by 24 inches high, required a relatively small portion of hot discharge flow, on the order of 1% to 10%, to be bypassed to this hot gas trace tube. Smaller systems may require a higher percentage of the total compressor discharge gas.

An electric heater in an embodiment according to the invention manages condensation on a cryogenic system, and applies heat directly to a service panel.

Figure 6:
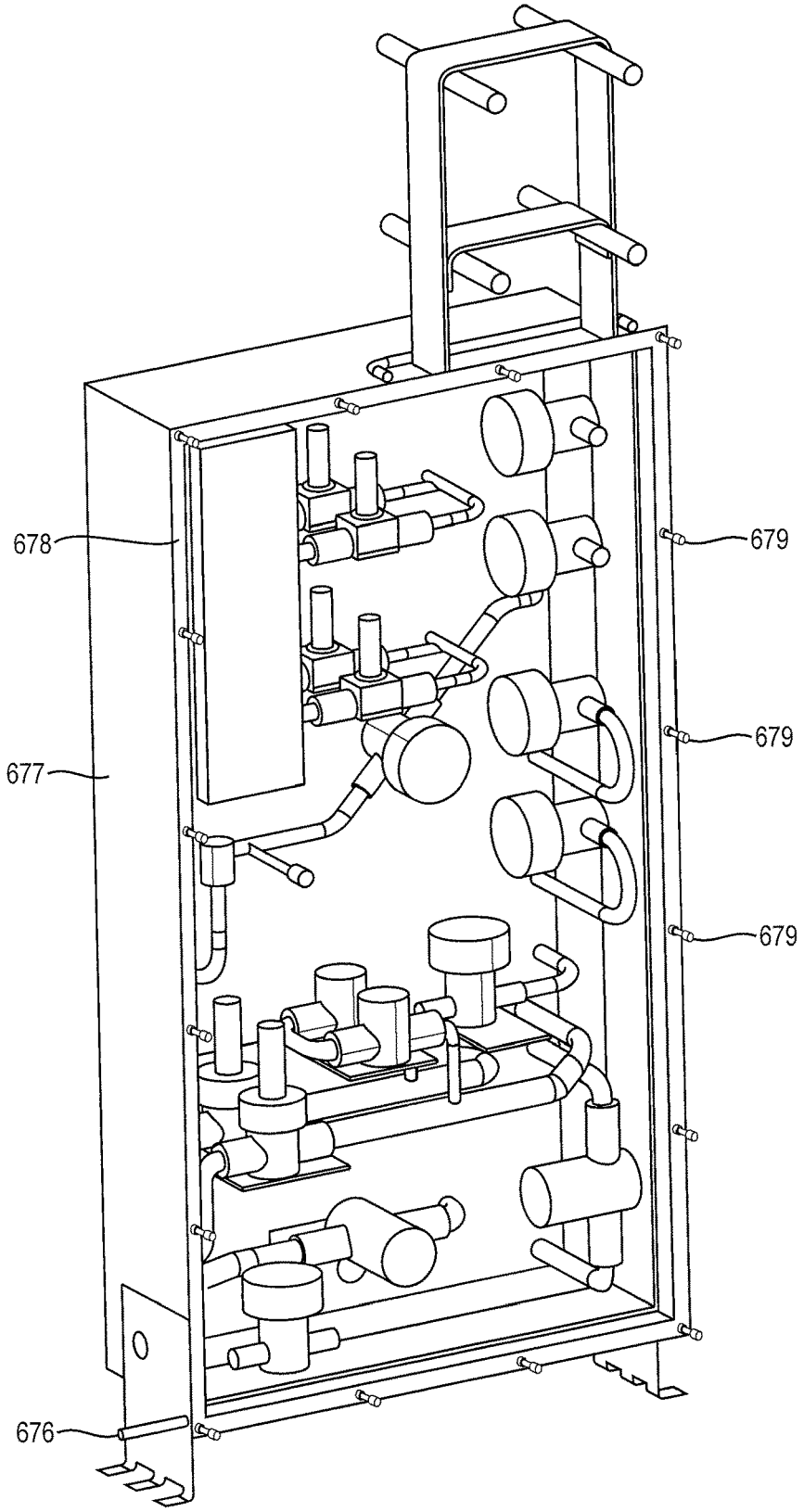
FIG. 6 is an inside view of a cold valve box, with which an embodiment according to the invention for preventing condensation may be used.

FIG. 6 is an inside view of a cold valve box 677, with which an embodiment according to the invention for preventing condensation may be used. The internal valves of the cold valve box are shown. Cold refrigerant flows through the tubing and the valves. Natural convection, and conduction to the valve box, can cause the flange temperature and the inside surface of the lid to become very cold and this can cause condensation on the lid unless there is some combination of insulation and active heating. In FIG. 6, the lid is not shown. It mounts up to the flange 678 using the hardware 679 shown.

A further advantage of active heating methods in accordance with an embodiment of the invention is the ability to warm the hand valves when no flow is through them. This shortens the time required to be able to operate these valves. Normally ice forms in the threads of the valve stem and prevents operation of the valves when cold. The presence of heat to the valve enclosure allows these valves to be warmed above the freezing point and thus allows a service technician to conduct repairs sooner than if no active heating was provided.

4. Predictive Diagnostics

Mixed gas refrigeration products are used for a number of customer critical processes. This may include operating a production line, or storage of biological samples. In these and many other industrial refrigeration applications unexpected loss of cooling or down time due to a fault are unacceptable due to the loss of productivity, resulting defective materials, or loss of critical research samples.

In accordance with an embodiment of the invention, predictive diagnostics permits a system to monitor itself and to detect trends that indicate that the system is at risk for a significant loss of cooling, or of a fault, in advance of such an event occurring. The intelligence of such predictive diagnostics is provided in one of two ways. A first method is to formally have the user confirm that it is running a baseline data set against which future data should be compared. A second method is for the system to perform self monitoring of the application and establish its own baseline against which future data will be compared.

Predictive diagnostics in accordance with an embodiment of the invention is based on a few key principles: transient performance monitoring, steady state performance monitoring, bin grouping, scaling temperatures based on changing external factors, and comparing duty cycles of control components.

In transient performance monitoring in accordance with an embodiment of the invention, the rate of change of key parameters such as temperatures or pressures are monitored. As an example, in the case of a cooling or heating application, the rate of change of refrigerant exiting a thermal mass, such as a chuck, or such as a coil of tubing, can be tracked over time. The slope of this temperature versus time relationship can be calculated for certain key thresholds. Similarly the time to reach such thresholds can also be tracked. This can provide a fundamental measurement of system cooling capacity. If the thermal mass is known this is an absolute measure of instantaneous cooling capacity. In many cases, though, the exact thermal mass information will not be available, in which case this provides an important relative comparison that can be tracked over many cool down cycles, assuming that the system set up remains a constant. Since refrigeration systems are driven by a compressor during such events the critical operating parameters of the compressor such as suction and discharge temperatures and pressures, compressor oil pump pressure, oil sump level, and amperage may be important factors to monitor. Once a formal or self assessed baseline is established, future transient events can be compared against this baseline and any deviations can be observed. These deviations can then be evaluated to assess the magnitude of the deviation and or the trend of this deviation. When the deviation or the deviation trend reaches a certain threshold, a warning or an alarm can be sent, depending on the magnitude. The thresholds can be established by the equipment manufacturer and or the end user.

In steady state performance monitoring in accordance with an embodiment of the invention, the system must be able to determine when the system has reached steady state. This may be determined by establishing either a time requirement and or an asymptote requirement (i.e., the rate of change of the temperature becomes very small). Once the requirements for steady state have been met, baseline data can be captured for comparison with future steady state conditions. If the observed steady state temperature deviates by a significant amount then a warning or alarm can be sent out, depending on the magnitude.

4a. Methods of Baselining:

In accordance with an embodiment of the invention, baselines can be generated in one of two methods. One method is a formal method in which the customer enters a command to the control system to initiate capturing of a baseline. The system then transitions the unit through various operating modes to obtain steady state and transient data. As an example, the system could transition through the modes of Standby, Cool, Defrost and then Standby. The system then records the data and stores this to compare future data against. Another method is a self assessed baseline. In this case, the system is continuously looking at the system state and determining when certain modes are enabled. For example, if the unit is switched from standby to cool the system will record the temperature versus time data for this mode change. In another example, once the unit has reached steady state conditions in the cool mode it will detect this and collect representative data. In this manner the system records transient and steady state data and averages the results of several repeat events. This average data then becomes the baseline that future data will be compared to. Such a baseline test may be conducted at the final installation, since the specific details of one installation can be unique. Factors such as cooling water temperature and flow rate, cryocoil length and diameter, line length and diameter, thermal radiation heat load, and power supply frequency (50 Hz vs. 60 Hz) all impact the system performance. Therefore obtaining a baseline at the specific installation of a particular unit is a useful reference point.

4b. Methods of Performance Monitoring when Capacity is Controlled:

In accordance with an embodiment of the invention, when the system's performance is being actively controlled, the knowledge of whether the system capacity is acceptable is more difficult to assess. As an example, during ramp control, the system is actively reducing the cool down rate to meet a customer requested target. As such the actual cooling capacity cannot be derived from a simple time versus temperature relationship. Rather, the system now needs to look at the duty cycle or loading of the control valve that is governing the cool down rate. In another example the system may be in a temperature control mode in steady state. In this case a loss of cooling capacity could go unnoticed if just based on the observed temperature. For this reason the system must also look at the duty cycle or loading of the temperature control valve.

For example, in accordance with an embodiment of the invention, if the valve is an on/off valve and the percentage of time in the "on" position changes over time then this may be evidence of a loss of cooling capacity. Similarly, for a system using a proportional valve for temperature control, the system can compare the percentage that the valve is open to the baseline data. A significant change in percentage that the valve is open to control the same temperature may indicate a loss of cooling capacity.

An embodiment according to the invention incorporates predictive diagnostics into a very low temperature mixed gas refrigeration system. Formal, user prompted baselines may be used. Further, the system may perform and create its own self assessed baseline. Further, the system may use data bins to group events based on the initial conditions (e.g., the coldest liquid temperature), and may use offsets to compensate for changes in external parameters such as cooling water temperature.

In accordance with the invention, the control system that performs the predictive diagnostics may be one or more of a control system located within the cooling system unit, a control system located remotely to the unit but located within the same facility, and/or a control system located remotely in another facility.

4c. Monitoring of Balance Pressure

In further embodiments the balance pressure observed at the conclusion of the warming process is used by the control system to determine if a significant change has occurred from previous warming processes. This can take many forms. For example, the control system could have had reference data manually entered, or may have automatically captured and stored reference value from earlier warming process operations. The control system could be one or more of a control system built into the unit, a control system that is remote from the unit but housed within the same facility, and/or a control system that is remote from the unit and housed in a separate facility. In essence the control system will compare the most recent balance pressure with the reference data and determine if a significant change has occurred. If a significant change has occurred then the control system can take some action to notify the operator that attention is needed to resolve the loss of pressure.

In accordance with an embodiment of the invention, the system controller keeps a record of the system balance pressure prior to the start of the machine. This may be done on the initial installation, during the first few starts, or on an ongoing basis. Along with the record of the balance pressure, at least one temperature within the heat exchanger array can be used to assess how fully warm the heat exchanger array is, since the balance pressure will be lower when the heat exchanger array is significantly colder than room temperature.

5. Temperature Control and Autotuning

In accordance with an embodiment of the invention, three types of temperature control have been developed.

5.1 One is simple on/off temperature control which is based simply on deadband control. This is used for the freezeout prevention valve.

5.2 The other is on/off temperature control in which the on/off time portions are optimized according to an autotuning algorithm. This is used with the on/off temperature control valves.

5.3 The third method is use of a stepper motor valve which provides proportional control. This is used for temperature control and is controlled using control parameters that are optimized using an autotuning algorithm.

5.4 is a combination of 5.2 and 5.3 in which a solenoid valve and a proportional valve are used in series.

For each of 5.1, 5.2, and 5.3, the valves could either be a normal refrigeration valve with limited temperature range or a cryogenic valve with a cryogenic temperature range. The following descriptions are for the case where the valve is managing refrigerant that is in a range of −40 C to +100 C. In this case, intermediate refrigerant from within the heat exchangers and phase separators of a mixed gas refrigeration system is used. Preferably this is taken from the vapor phase of the coldest phase separator. This may be performed, for example, using any of the methods disclosed in U.S. Pat. No. 7,478,540 B2 of Flynn et al., the entire disclosure of which is hereby incorporated herein by reference. Preferably this fluid is warmed prior to entering the control valve by exchanging heat with another, warmer fluid stream in the system such as the compressor discharge line or the refrigerant exiting the condenser. If these were capable of operating at cryogenic temperatures an additional option would be for these valves to directly manage the cryogenic fluid exiting the system rather than injecting a warmer temperature fluid into the cryogenic feed stream.

5.1

In accordance with an embodiment of the invention, the freezeout prevention circuit injects warm refrigerant gas to the coldest low pressure refrigerant in the system. This warms the refrigerant at this part of the process and results in warming of the high pressure refrigerant that is exchanging heat with this low pressure refrigerant. The valve is controlled based on a simple open and close temperature limits. When the temperature falls too low the valve opens. When the temperature becomes too warm it closes. The sensing temperature may either be the temperature of high pressure refrigerant exiting the coldest heat exchanger, or the temperature of this high pressure refrigerant after it has been expanded to low pressure or it could be the low pressure refrigerant exiting the coldest heat exchanger or it could be a combination of any of these temperatures combined in a weighted average fashion.

5.2 & 5.3

In accordance with an embodiment of the invention, a temperature control auto-tuning algorithm design finds a suitable set of controller parameters to regulate temperature at a specified location with reasonable performance. In the past, temperature controller parameters needed to be designed and tuned for specific hardware configurations and installations. Most of the time, it would need a highly trained controls engineer to analyze the characteristics of the particular hardware configuration and design the controller manually for each installed unit. Sometimes, this process can be tedious and may take a significant amount of time just to find the starting stable set.

An auto-tuning algorithm in accordance with an embodiment of the invention automates and streamlines the characterization, analysis, and design process for the temperature controller. The algorithm can be run with minimal supervision and will provide a stable set of controller parameters based on data collected on the particular hardware. This automated process will simplify the design process and allow controller tuning to be carried out by a technician without much knowledge of controls engineering. Therefore, auto-tune will help minimize the engineer's time needed for each installed unit.

5.4

The merits of the auto-tune algorithm in accordance with an embodiment of the invention, which is a highly automated/streamlined characterization-analysis-design process, can be extended to a variety of different products that require temperature control. A potential limitation is in the existence of a reliable design method that can guarantee a stable/robust design without much sacrifice on system performance. However, for most thermal dynamical systems, stability requirements outweigh performance demands. Conservative standardized designs should be sufficient to meet product specifications.

An auto-tuning algorithm in accordance with an embodiment of the invention consists of the following steps:

Bring the cooling system to a known state, that is, STANDBY mode. Customer thermal load should be disconnected.

Start the refrigerant flow to the circuit until the temperature reach and stabilize to the minimal temperature Turn on temperature control valve to maximal value and record the time and temperature periodically Compute the system characteristics (delay time and temperature rising rate) and design a PI controller for "control on" condition After temperature stabilized, close temperature control valve completely and record the time and temperature periodically Compute the system characteristics (delay time and temperature falling rate) and design a PI controller for "control off" condition Compare the two designs ("control on" and "control off") and select/save the conservative one for starting stable design.

In accordance with an embodiment of the invention, during the cooling/heating process, temperature is closely monitored to prevent unstable and potentially hazardous conditions. To reliably detect the condition for stable temperature, a moving-window scheme is implemented. To qualify for stable condition, the measured temperature needs to be within a tight range (for example, 2 degrees C. as default), within a given time period (for example, 4 minutes as default).

In accordance with an embodiment of the invention, a final selection process compares the proportional gains between the two designs and chooses the set with the lower value.

In an embodiment according to the invention:

A dual-step design is used to capture system characteristics for both positive control (rising temperature) and negative control (falling temperature).

A selection process is used to ensure a successful finding of a starting stable parameter set.

A moving-window scheme is used to reliably determine temperature stability and detect error/unstable condition during the auto-tune process.

In the case where an on/off valve and a proportional valve are used there is an additional dimension of optimization required.

In accordance with an embodiment of the invention, temperature control is performed in a refrigeration system, with auto-tuned parameters for performance optimization.

In accordance with an embodiment of the invention, cold refrigerant cools a circuit temperature down and hot gas warms it up. In this mode an embodiment according to the invention controls a circuit temperature by controlling the amount of hot gas provided by a proportional valve. If the opening level of proportional valve is larger than a configurable amount (for example, default 25%), then it is determined that there is excess capacity. In accordance with the invention, the control system that performs the temperature control function may be one or more of a control system located within the cooling system unit, a control system located remotely to the unit but located within the same facility, and/or a control system located remotely in another facility.

6. Adaptive Power Management

Energy consumption of refrigeration equipment represents a significant operational cost for capital equipment. Reducing this energy consumption is a desirable goal to reduce power consumption wherever possible. In particular the benefit of power consumption when the customer process is in an idle mode can be a relatively high cost which provides little benefit.

To address this concern several methods to reduce power consumption are provided, in accordance with an embodiment of the invention. Important for any power management strategy is an intelligent controller to determine when it is an appropriate time to reduce power consumption. Two types of intelligence are provided in accordance with an embodiment of the invention. One is determining when the unit is in an idle mode. In this case power reduction is implemented based on a combination of time and or system temperature. Another is determining when a cooling system has excess cooling (or heating) capability and can reduce its power consumption while still providing the required capacity. The four methods considered are: variable speed drive, cylinder unloading, scroll unloading, and use of two or more compressors in parallel.

In accordance with an embodiment of the invention, Cryochiller Power Management is used to reduce the power consumed by the compressor when the unit has excess cooling capacity.

In accordance with an embodiment of the invention, Cryochiller software monitors the unit cooling demand and determines when the unit has excess cooling capacity. If the cooling capacity is excessive then the power reduction option is activated by engaging the Cylinder Unloader, providing a reduction in cooling power.

6.1 Cylinder Unloading

In accordance with an embodiment of the invention, a solenoid is activated which causes one of the three cylinder heads to have its inlet blocked. This reduces flow by, for example, ⅓rd and results in a power reduction of, for example, about 30% (when under full load; at low loads the power savings is only about 10%). While this feature is activated the solenoid is de-energized for a short percentage of time. As an example, the interval of de-energizing the solenoid valve could be 10 to 120 seconds every hour or every four hours or every day. This is performed to prevent an accumulation of oil at the suction reed valve, which can damage the reed valve. When full capacity is required the solenoid is de-energized. The user has the option to adjust a time delay regarding when to activate the cylinder unloader, and to turn this feature off entirely. The system automatically exits the unloading mode when additional cooling capacity is needed, such as when transitioning from one mode to another, for example transitioning from Standby to Cool mode.

6.2 Excess Cooling Capacity Conditions

In accordance with an embodiment of the invention, excess cooling capacity is determined as follows:

In Standby Mode: The Cryochiller enters this power saving mode after a configurable period of time (for example, default of 20 minutes) in the standby mode. Alternatively, the system enters power saving mode in the Standby mode once a particular system temperature is cooled to a sufficiently low temperature, or when the duty cycle of the freezeout prevention valve reaches a particular duty cycle. For systems using more than one coupled very low temperature refrigeration systems, both circuits must be in standby for this length of time. The unit can be configured to exit the power saving mode when transitioning from Standby to Cool mode.

In Standard Cooling Mode: Standard Cool Mode does not have a cool setpoint. The customer specifies the minimum required temperature as a configuration point. If the circuit is in standard cool mode and return temperature is more than a configurable amount (for example, a default of 2 degrees) colder than the configured minimum then it is determined that there is excess cooling capacity. If the required temperature achieved when power management is activated, exceeds a determined limit the system can exit the power saving mode.

In Temperature controlled Cooling Mode with Cool valve On/Off: If the percentage of time the cool valve is open for the last few minutes is less than a configurable amount (for example, default of 75%) then it is determined that there is excess capacity.

In Temperature controlled Cooling Mode with proportional valve: In Temperature controlled Cooling Mode with proportional vale, the cool valve is constantly open and provides cold refrigerant while the proportional valve provides refrigerant gas which can cause the warming of the cold refrigerant in order to achieve a desired temperature.

In accordance with an embodiment of the invention, there is provided a method of determining excess cooling capacity without temperature control, and activating Cylinder unloading when it is determined that there is excess cooling capacity. Further, there is provided a method of determining when the system has excessive cooling capacity with temperature control by looking at the duty cycle of the control valve, and activating Cylinder unloading when it is determined that there is excess cooling capacity.

The above examples refer to use of a cylinder unloader which results in a step change in system capacity. In accordance with an embodiment of the invention, this can be done at a level of one cylinder or one head. In the above examples a six cylinder compressor with three heads was used and in this case one entire head was unloaded which reduced displacement by 33%. Other arrangements are possible such as one cylinder ($1/6^{th}$ reduction in displacement), three cylinders (50%), etc. It is also possible that the extent of unloading is varied such that greater unloading is performed based on the amount of excess cooling capacity. Another method of achieving variable unloading of the cylinders is to pulse the unloader valve. Such a pulsing method can be used to achieve a degree of unloading that is between zero unloading (as when the unloader is not activated), and maximum unloading (as when the unloading is continuously activated for a particular cylinder or pair of cylinders).

6.3 Variable Speed and Scroll Unloading Methods:

Other options for achieving variable levels of unloading can be attained using two alternate methods, in accordance with an embodiment of the invention.

One method is to implement a variable speed control. In this method the compressor displacement can be varied continuously based on the cooling capacity required. Typically the motor speed can be varied to a level higher than normal which can result in an increased compressor displacement. This method is applicable to all types of compressors that are operated by an electric motor.

An alternate method is specific to scroll compressors. In this method the spacing between the scrolls of the compressor are varied slightly in order to reduce the effective displacement. Suitable scroll compressors are marketed as "digital scrolls" and "Scroll Ultratech Compressors" under the Copeland Scroll® brand of Emerson Climate Technologies of Sidney, Ohio, U.S.A.

In accordance with an embodiment of the invention, cylinder unloaders on reciprocating compressors are used in combination with an assessment of excess cooling capacity. Further, such features are used in a mixed gas refrigeration system. Further, variable speed or scroll unloading may be used in a mixed gas refrigeration system.

In accordance with an embodiment of the invention, it should be appreciated that an element of mixed gas refrigeration where unloading becomes a concern has to do with the need to maintain a minimum velocity to achieve good management of the mixed refrigerant and good heat transfer. This means that the degree of unloading cannot be excessive. For example if the system was unloaded to 10% of capacity the velocities would become too low in the heat exchangers, resulting in poor cooling performance. This is due to two factors. The first is the need for sufficient velocities in the heat exchangers to be effective. The second is the need to achieve homogenous flow of the liquid and vapor phases. This is important in mixed gas refrigeration systems since the vapor phase and liquid phase have much different refrigerant compositions.

6.4 Multiple Compressors in Parallel:

In accordance with an embodiment of the invention, when a cryochiller system is configured with multiple compressors acting in parallel, it is possible to reduce the power consumption by turning off one or more compressors. These compressors could either be of the same or different displacement. One or more could be equipped with their own power management capability such as cylinder unloading, variable speed drive, or scroll separation. In order to reduce the power consumption of a cryochiller with multiple parallel compressors at least one compressor remains in operation while at least one other compressor is turned off, or is operated at reduced displacement. This allows the amount of mass flow to be reduced and for the amount of required power to be reduced. Alternatively, the compressor in operation could utilize a reduced displacement operation while at least one other compressor is turned off. When operating compressors in parallel, care must be taken to ensure adequate oil return to each compressor and to ensure that when one compressor is turned off that reverse flow cannot occur through it.

In accordance with an embodiment of the invention, a very low temperature refrigeration system that uses a mixed gas refrigerant may be configured to reduce its power consumption by determining when the system has excess cooling capacity; and reducing power consumption of the system's compressor while still delivering a required amount of cooling capacity to a load. The system may be configured to reduce the power consumption by including at least one control module configured to: (i) engage a cylinder unloader of the compressor; (ii) vary a motor speed of the compressor; (iii) vary scroll spacing of a scroll compressor; and (iv) where the very low temperature system comprises more than one compressors in parallel, maintain a first compressor of the more than one compressors in operation while turning off a second compressor of the more than one compressors or operating the second compressor at a reduced displacement. The one or more control modules may be configured to determine when the very low temperature refrigeration system has excess cooling capacity by at least one of: determining whether a return temperature from the load is more than a predetermined amount of temperature difference colder than a predetermined minimum temperature; monitoring a percentage of time that a cool valve is open and comparing the percentage of time with a predetermined percentage; monitoring a percentage of time that a temperature control valve is open and comparing the percentage of time with a predetermined percentage; and determining an amount that a proportional valve is opened.

7. Cryochiller with Web GUI Control Interface

In accordance with an embodiment of the invention, there is provided an easy to use, intuitive graphical user interface (GUI) to monitor and control a cryochiller, such as a very low temperature refrigeration system using mixed refrigerants. More specifically, this interface is a web based GUI in which the refrigeration system is the server that hosts a web page that a user can access using an internet protocol address. Through this interface the user can monitor and control the refrigeration system.

An embodiment according to the invention improves the ease of use of the refrigeration system by making it easier to input parameter values and change unit states. Further, this can be done without needing to learn specific command lexicon and without needing to know specific parameter values needed to enact specific actions. Rather, it provides an easy to use interface where a user can enter in parameter values and have them accepted. It also incorporates a real time monitor and control which emulates the human machine interface on the unit's control panel. Further, it provides values for all of the temperatures, pressures, voltages and other sensors measured by the system. It also provides information of the logic state of all solenoid activated valves, contactors and relays. Further, it provides position information for proportional valves.

An embodiment according to the invention provides a web based Active Server Page (ASP) user interface. Users are able to connect to the device over a network, such as by using an Ethernet connection, using a web browser to view and interact with the device through a set of active server web pages. The Web interface must be granted control by another interface of the refrigeration system, if it is desired that the Web GUI will control the device. This Ethernet based GUI is hosted on the refrigeration system itself with the web server, which may, for example, be provided as part of an operating system of a processor on board the refrigeration system. In one example, the interface is operated on a Win CE platform (of the Windows operating system sold by Microsoft Corporation of Redmond, Wash., U.S.A.). In this example, support for this interface requires that the operating system be configured through catalog selection of the WinCE IDE with the Web server component and the Active Server Page and scripting support.

An embodiment according to the invention provides a GUI for the refrigeration system, accessible through a web browser. Through these web pages, a user can easily access any important information for the operation or configuration or service of the unit. With submission of a valid password, and provided that the system is configured to allow remote access by Web GUI, the user can modify the unit state and key control parameters of the refrigeration system. Conventional cryochillers relied on a variety of simple electrical or electronic interfaces. These included simple relay logic using 24 V input or output signals, or relied on RS-232, RS-485 or similar serial or parallel standard industry interfaces. Each of these required either custom wiring, as in the case of 24 V signals, or custom command routines as in the case of the standard industry interfaces. In contrast, a Web GUI according to an embodiment of the invention provides a means for the user to remotely control the unit without needing to develop custom wiring, or the need for custom programming.

Figure 7:
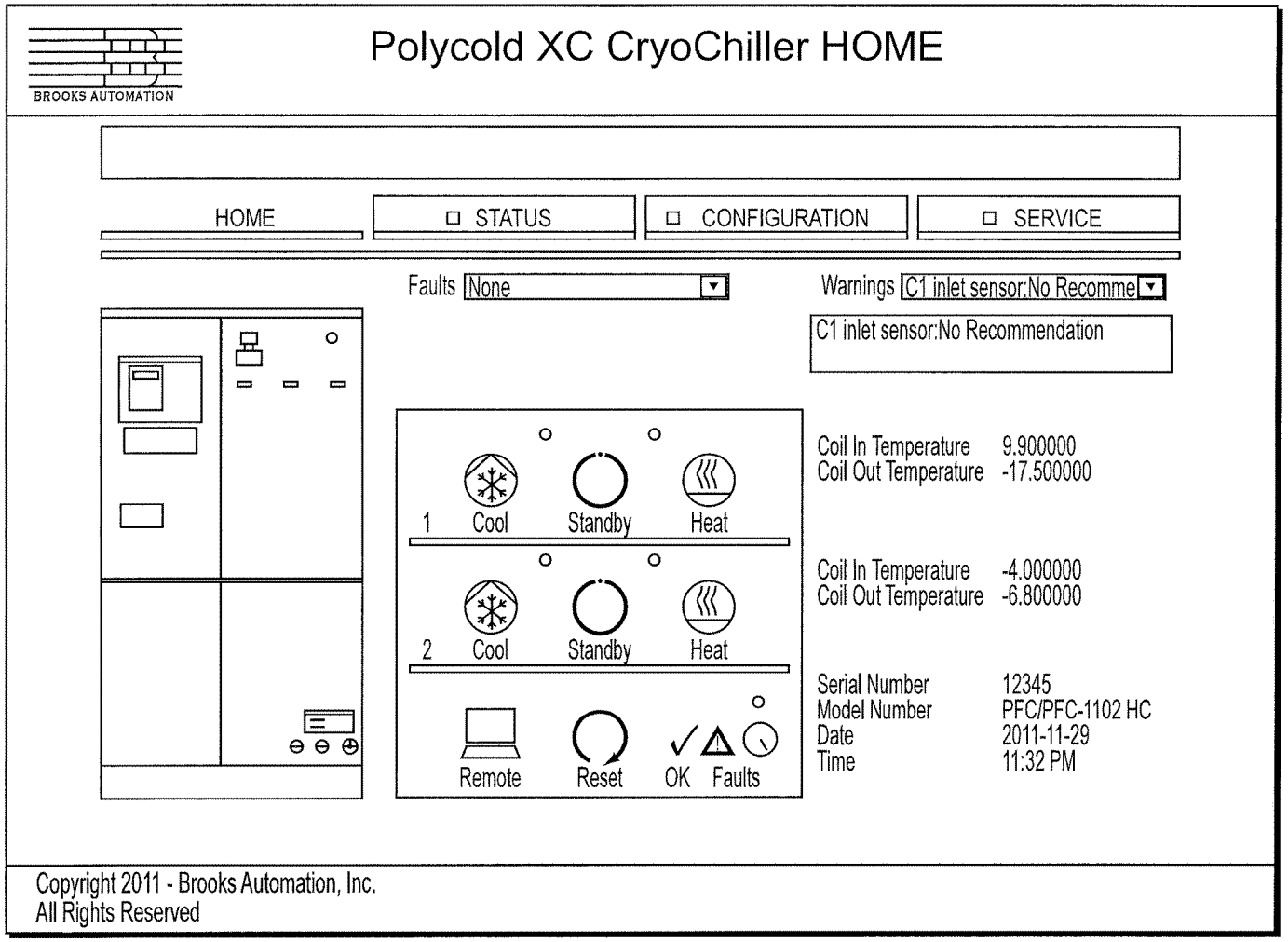
FIG. 7 is a screen shot of a home page from an implemented Web GUI in accordance with an embodiment of the invention.

FIG. 7 is a screen shot of a home page from an implemented Web GUI in accordance with an embodiment of the invention, which includes a facsimile of the user key pad of the refrigeration system. Using point and click interactions with the Web GUI, the user can change the unit mode. Also, hovering the mouse pointer over key features causes an explanation of the button or LED's to come up which explains the function of the switch. Boxes with fault of warning information are also displayed, along with key information about the unit and its current operating state.

FIG. 8 is a screen shot of a status page from an implemented Web GUI in accordance with an embodiment of the invention, which provides an overview of all important sensors and operating mode data.

Figure 9:
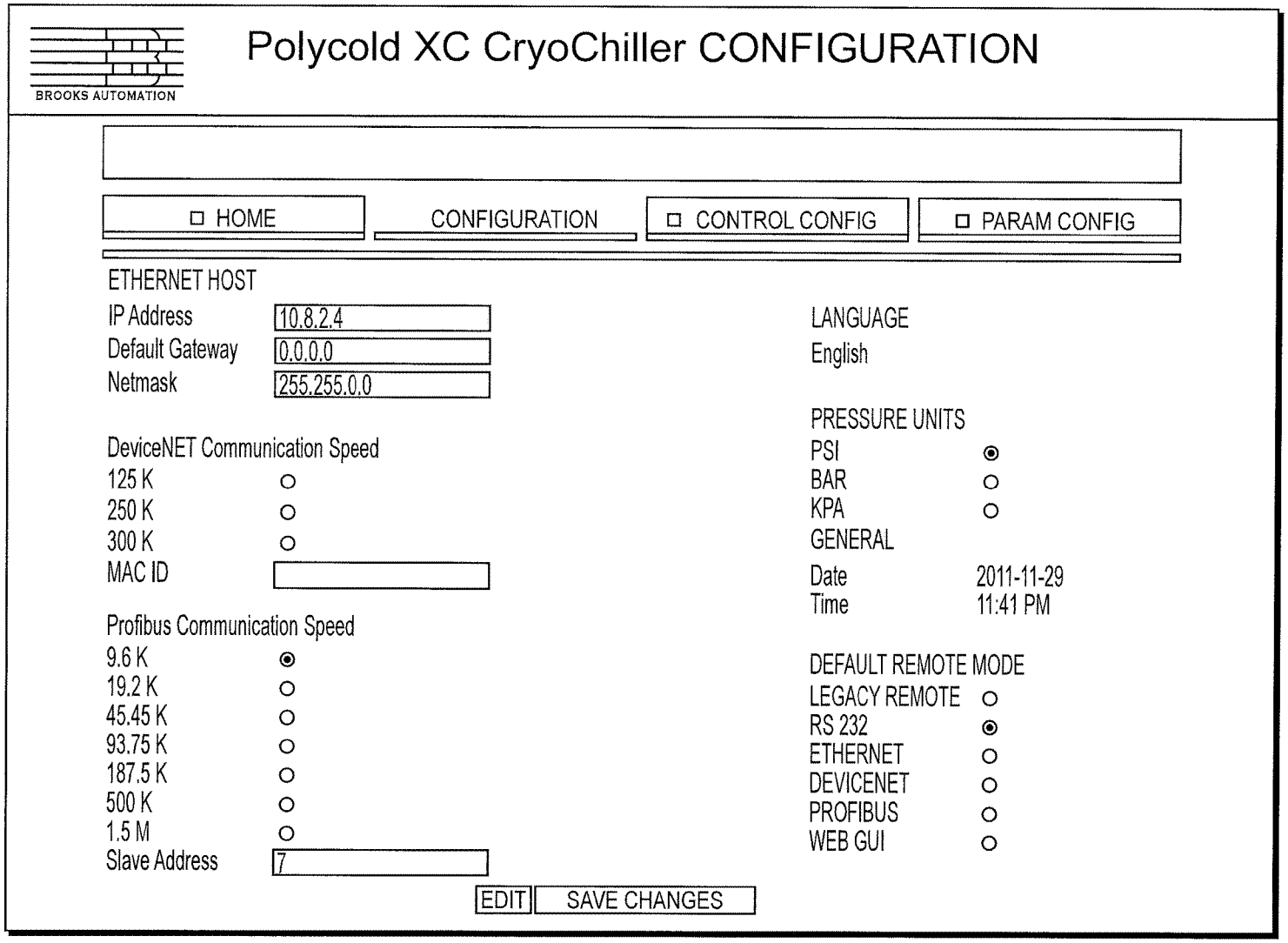
FIG. 9 is a screen shot of a communication page from an implemented Web GUI in accordance with an embodiment of the invention.

FIG. 9 is a screen shot of a communication page from an implemented Web GUI in accordance with an embodiment of the invention, which provides communication protocol information and units of measure information, and allows selection of each.

Figure 10:
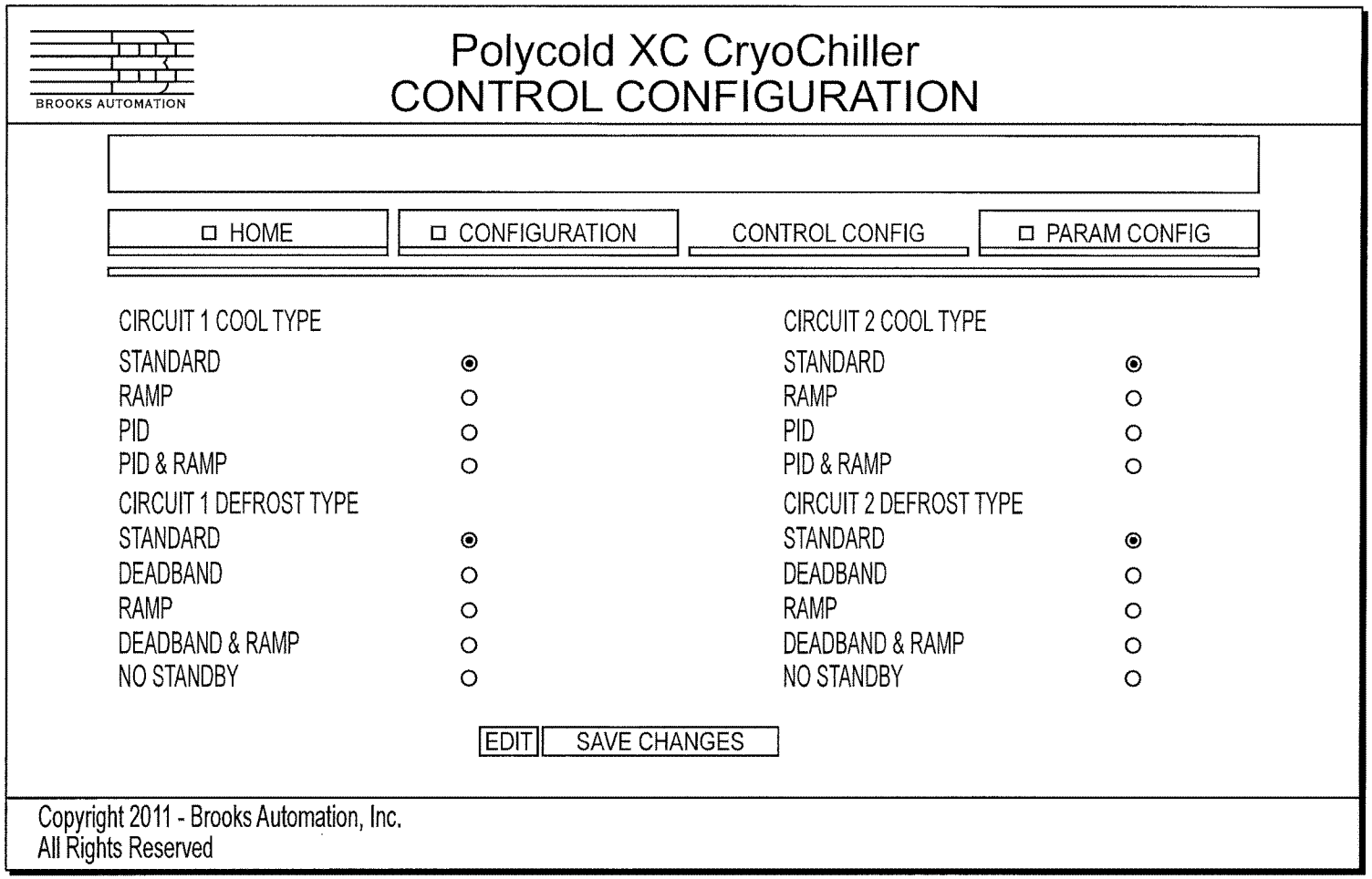
FIG. 10 is a screen shot of an operating mode page from an implemented Web GUI in accordance with an embodiment of the invention.

FIG. 10 is a screen shot of an operating mode page from an implemented Web GUI in accordance with an embodiment of the invention, which provides information about, and allows selection of the configuration of, the operating modes of the refrigeration system.

Figure 11:
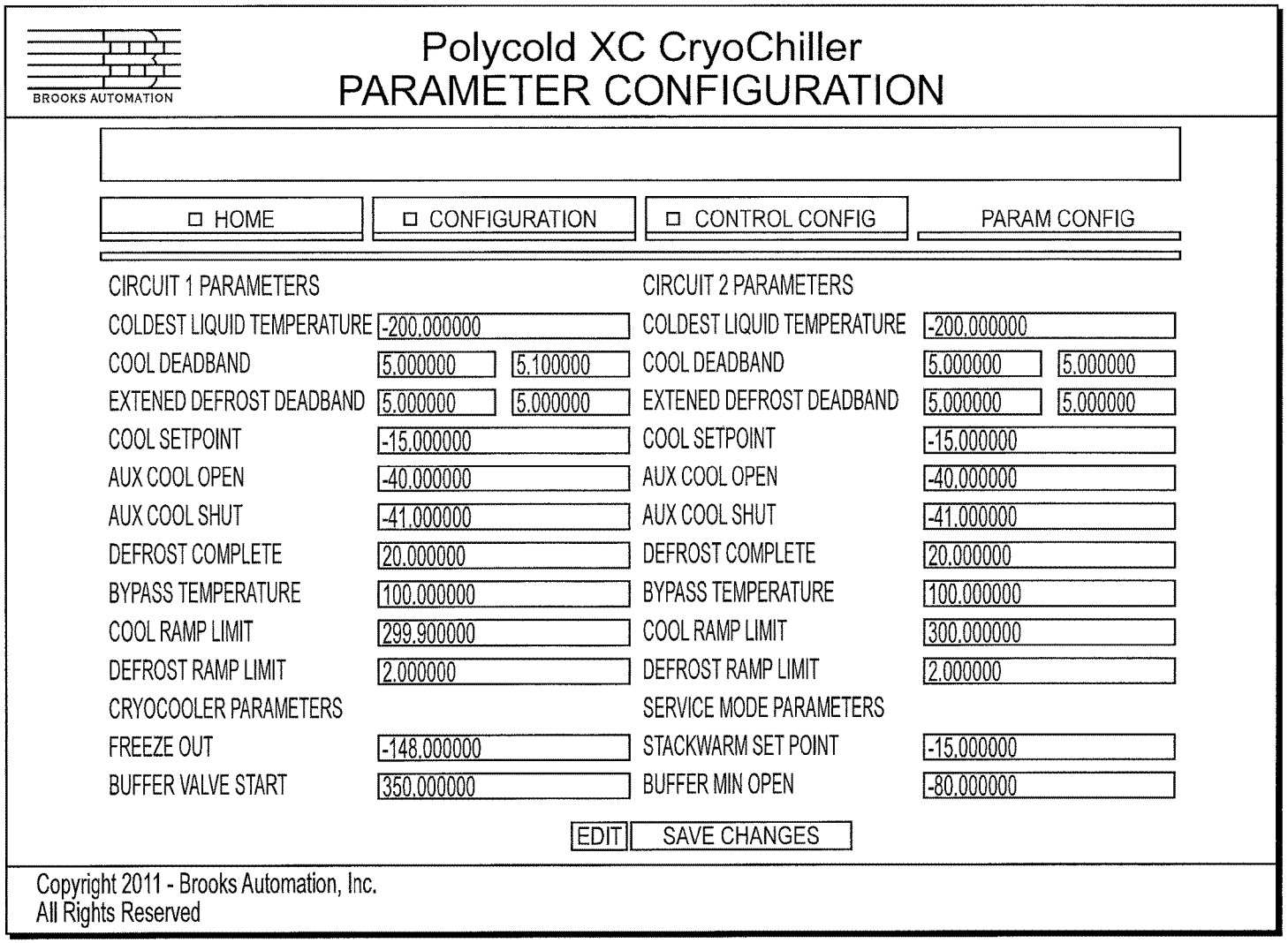
FIG. 11 is a screen shot of a control page from an implemented Web GUI in accordance with an embodiment of the invention.

FIG. 11 is a screen shot of a control page from an implemented Web GUI in accordance with an embodiment of the invention, which provides information about, and allows selection of, important control parameters for the refrigeration system.

Figure 12:
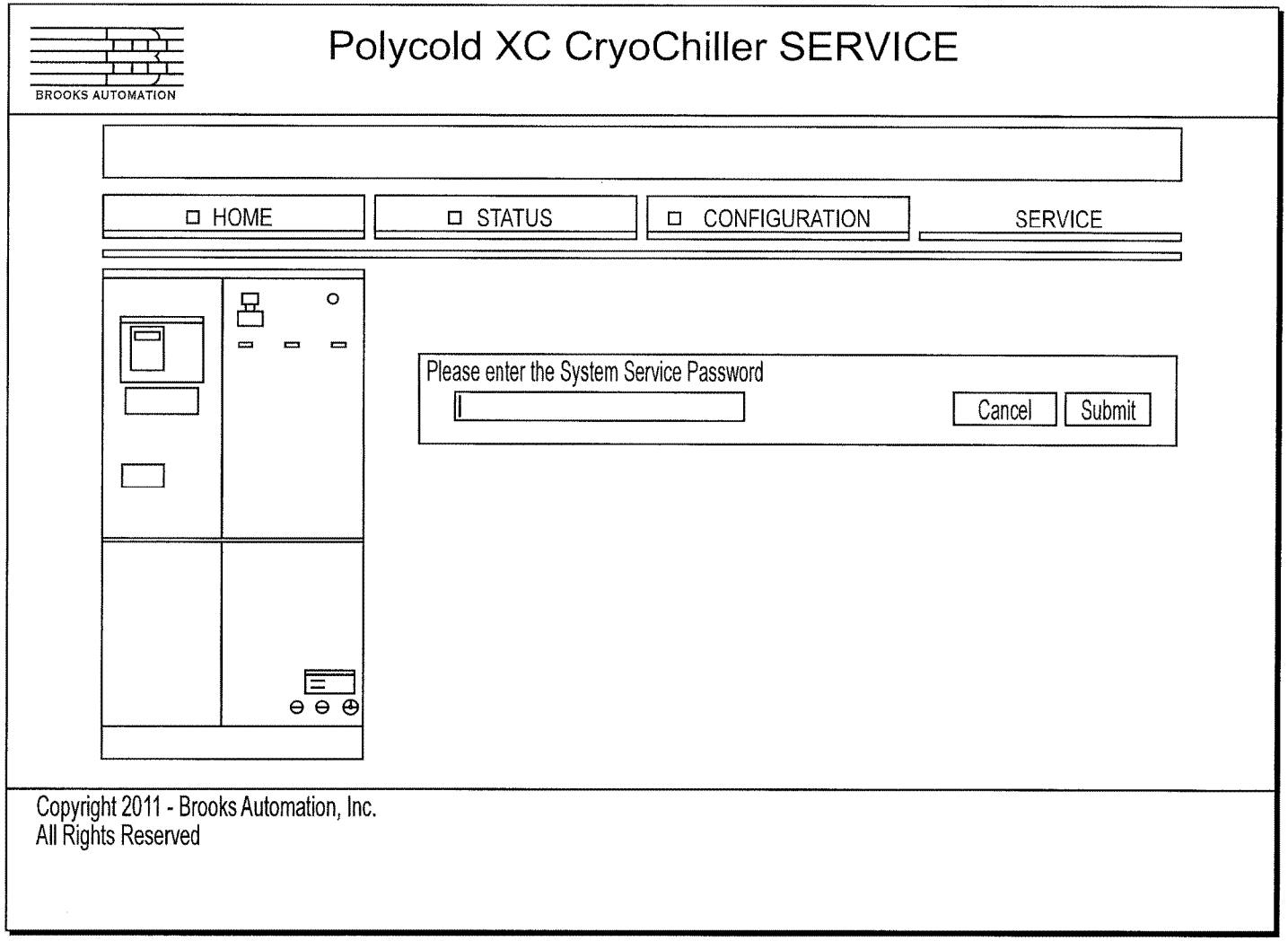
FIG. 12 is a screen shot of a service page from an implemented Web GUI in accordance with an embodiment of the invention.

FIG. 12 is a screen shot of a service page from an implemented Web GUI in accordance with an embodiment of the invention, which allows users to access service features by entering a password.

Screen shots shown herein represent examples that may be used in possible implementation of an embodiment according to the invention, and are representative of the capability of the Web GUI. Many other possible sensor values and control parameters are possible to be displayed.

In accordance with an embodiment of the invention, the controller of a very low temperature refrigeration system hosts its own webpage for its GUI. Alternatively, a remote server could collect data from the refrigeration system and host a web page system to provide a GUI of the refrigeration system. Where the system hosts its own webpage, a user may be permitted to monitor the system remotely through the GUI, but is only permitted control over the system if another interface of the system is configured and activated to permit the user to control the system. A processor in the control system of the refrigeration system may run an operating system, which hosts the webpage for the GUI of the refrigeration system. The GUI may be accessed over a variety of different possible networks, such as Ethernet, WiFi or cellular networks. Using the GUI, the user can view the web pages, change settings of the unit (for example, the operating mode), change the value of control parameters, or send discrete commands to the unit. The user may receive data from the unit, or send commands to the unit (either through the GUI or by sending an explicit command over the network). The refrigeration system may have its own web page, and/or individual components of the system (such as the compressor) may have their own web pages, with interne protocol addresses for each.

8. Control Systems; Computer Implemented Systems

In accordance with an embodiment of the invention, various techniques set forth herein are implemented using control systems, and may include computer implemented components.

Figure 13:
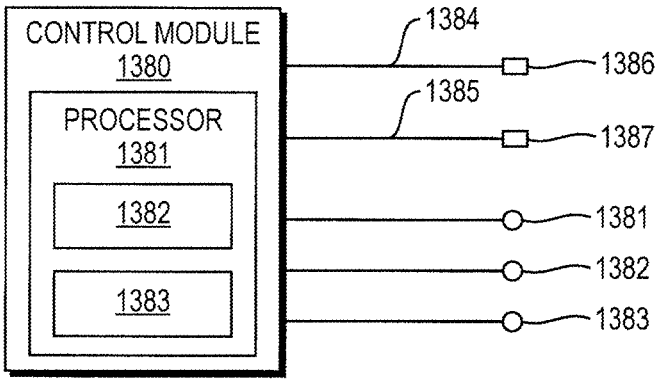
FIG. 13 is a simplified schematic block diagram of a control system that may be used in accordance with an embodiment of the invention.

FIG. 13 is a simplified schematic block diagram of a control system that may be used in accordance with an embodiment of the invention. Control techniques discussed herein may be implemented using hardware, such as a control module 1380 that includes one or more processors 1381, which may for example include one or more Application Specific Integrated Circuits (ASICs) 1382, 1383; application software running on one or more processors 1381 of the control module 1380; sensor lines 1384, 1385 delivering electronic signals from sensors that are coupled to systems set forth herein (such as sensor lines from temperature sensors 1386 and pressure sensors 1387) to the control module 1380; and actuator lines 1381-1383 delivering electronic signals to actuated components within systems set forth herein (such as actuator lines delivering electronic signals to actuated valves as at 1381, to one or more compressors as at 1382, to a variable frequency drive as at 1383 or other controlled components). It will be appreciated that other control hardware may be used, including control hardware that is at least in part pneumatic. In addition, it will be understood that embodiments according to the invention may be implemented by modifying control systems of existing, conventional units, in the field, for example as a retrofit of an existing conventional unit.

Portions of the above-described embodiments of the present invention can be implemented using one or more computer systems, for example to permit automated implementation of control techniques for refrigeration systems and related components discussed herein. For example, the embodiments may be implemented using hardware, software or a combination thereof. When implemented in software, the software code can be executed on any suitable processor or collection of processors, whether provided in a single computer or distributed among multiple computers.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, at least a portion of the invention may be embodied as a computer readable medium (or multiple computer readable media) (e.g., a computer memory, one or more floppy discs, compact discs, optical discs, magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

In this respect, it should be appreciated that one implementation of the above-described embodiments comprises at least one computer-readable medium encoded with a computer program (e.g., a plurality of instructions), which, when executed on a processor, performs some or all of the above-discussed functions of these embodiments. As used herein, the term "computer-readable medium" encompasses only a computer-readable medium that can be considered to be a machine or a manufacture (i.e., article of manufacture). A computer-readable medium may be, for example, a tangible medium on which computer-readable information may be encoded or stored, a storage medium on which computer-readable information may be encoded or stored, and/or a non-transitory medium on which computer-readable information may be encoded or stored. Other non-exhaustive examples of computer-readable media include a computer memory (e.g., a ROM, a RAM, a flash memory, or other type of computer memory), a magnetic disc or tape, an optical disc, and/or other types of computer-readable media that can be considered to be a machine or a manufacture.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A method of warming a heat exchanger array of a very low temperature refrigeration system, the method comprising:

diverting at least a portion of refrigerant flow in the refrigeration system away from a refrigerant flow circuit used during very low temperature cooling operation of the refrigeration system, to effect warming of at least a portion of the heat exchanger array; and while diverting the at least a portion of refrigerant flow, reducing refrigerant mass flow through a compressor of the refrigeration system, the reducing refrigerant mass flow comprising one of: (a) operating a buffer valve to permit refrigerant to be stored in at least one of an expansion tank and a buffer tank of the refrigeration system; (b) applying a variable speed drive to the compressor; (c) blocking mass flow into at least one cylinder of the compressor, the compressor being a reciprocating type compressor; (d) separating at least two scrolls of the compressor from each other, the compressor being a scroll type compressor; and (e) reducing mass flow of at least one compressor of multiple compressors of the refrigeration system, or curtailing operation of said at least one compressor of said multiple compressors of the refrigeration system;

the reducing refrigerant mass flow being continued during a warming process of the very low temperature refrigeration system from commencement of the reducing refrigerant mass flow until both a high pressure of the refrigeration system and a low pressure of the refrigeration system are within a pressure difference of 30 psi or less away from a natural balance pressure of the system.

2. A method according to claim 1, wherein the diverting at least a portion of the refrigerant flow comprises diverting at least a portion of refrigerant flow from the compressor to a point in the heat exchanger array.

3. A method according to claim 2, wherein the point in the heat exchanger array comprises a low pressure inlet of a coldest heat exchanger in the heat exchanger array.

4. A method according to claim 2, wherein the point in the heat exchanger array comprises a low pressure inlet of a next-to-coldest heat exchanger in the heat exchanger array.

5. A method according to claim 1, comprising operating the buffer valve continuously.

6. A method according to claim 1, comprising operating the buffer valve in a pulsed manner.

7. A method according to claim 1, comprising operating the buffer valve after a minimum suction pressure is reached.

8. A method according to claim 1, wherein the diverting at least a portion of the refrigerant flow comprises diverting at least a portion of refrigerant flow from an outlet of a condenser of the refrigeration system to a point in the heat exchanger array.

9. A method according to claim 1, wherein the diverting at least a portion of the refrigerant flow comprises diverting at least a portion of refrigerant flow from a high pressure side of at least one heat exchanger in the heat exchanger array to another point in the heat exchanger array.

10. A method according to claim 1, wherein the diverting at least a portion of the refrigerant flow comprises diverting at least a portion of refrigerant flow from a sequence of at least two sources of warming refrigerant in the refrigeration system, the at least two sources of warming refrigerant comprising at least one of: (i) different temperatures from each other, and (ii) different refrigerant compositions from each other.

11. A method according to claim 10, wherein the diverting at least a portion of the refrigerant flow comprises diverting at least a portion of refrigerant flow from an alternating sequence of the at least two sources of warming refrigerant in the refrigeration system.

12. A method according to claim 1, wherein the diverting at least a portion of the refrigerant flow comprises diverting at least a portion of refrigerant flow from at least two sources of warming refrigerant in the refrigeration system, the at least two sources of warming refrigerant comprising at least one of: (i) different temperatures from each other, and (ii) different refrigerant compositions from each other; and blending the diverted flow from the at least two sources of warming refrigerant to effect the warming of the at least a portion of the heat exchanger array.

13. A method according to claim 1, wherein the diverting at least a portion of the refrigerant flow comprises varying an amount of warming refrigerant during warming of the at least a portion of the heat exchanger array.

14. A method according to claim 1, wherein the diverting at least a portion of the refrigerant flow comprises diverting refrigerant flow to more than one location in the heat exchanger array.

15. A method according to claim 1, wherein the diverting at least a portion of refrigerant flow comprises diverting at least a portion of the refrigerant flow from an outlet of the compressor to an inlet of a feed line from which refrigerant flows to at least one of a cryocoil or cryosurface and from there returns through a return line to a low pressure side of the heat exchanger array.

16. A method according to claim 15, wherein the diverting is continued after a temperature of the refrigerant in the return line returning to the low pressure side of the heat exchanger array has reached a high temperature set point of the return line.

17. A method according to claim 15, comprising operating the buffer valve continuously.

18. A method according to claim 15, comprising operating the buffer valve in a pulsed manner.

19. A method according to claim 15, comprising operating the buffer valve after a temperature of the refrigerant in the return line returning to the low pressure side of the heat exchanger array has reached a high temperature set point of the return line.

20. A method according to claim 15, comprising operating the buffer valve throughout the diverting of at least a portion of the refrigerant flow from an outlet of the compressor to an inlet of a feed line.

21. A method according to claim 15, wherein the diverting to the inlet of the feed line is continued until a temperature of the refrigerant in the return line returning to the low pressure side of the heat exchanger array has reached a high temperature set point of the return line, after which the diverting comprises diverting at least a portion of refrigerant flow from the compressor to a point in the heat exchanger array.

22. A method according to claim 1, wherein the diverting at least a portion of refrigerant flow comprises diverting at least enough refrigerant flow to exceed a cooling effect produced by at least one internal throttle of the heat exchanger array, thereby warming the heat exchanger array.

23. A method according to claim 1, comprising at least partially closing at least one internal throttle of the heat exchanger array for at least a portion of the warming of the heat exchanger array.

24. A method according to claim 1, comprising at least partially blocking flow into or out of a condenser of the refrigeration system for at least a portion of the warming of the heat exchanger array.

25. A method according to claim 1, comprising closing a suction side connection to an expansion tank of the refrigeration system for at least a portion of the warming of the heat exchanger array.

26. A method according to claim 1, comprising controlling a location in the heat exchanger array to which the diverted refrigerant flow is directed.

27. A method according to claim 1, wherein the method comprises using no equipment external to the refrigeration system to effect warming of the heat exchanger array.

28. A method according to claim 1, wherein the reducing refrigerant mass flow is continued until both a high pressure of the refrigeration system and a low pressure of the refrigeration system are within a pressure difference of at least one of 5 psi, 10 psi and 20 psi or less away from a natural balance pressure of the system.

* * * * *